United States Patent [19]

Enriquez et al.

[11] Patent Number: 4,473,133

[45] Date of Patent: Sep. 25, 1984

[54] ELEVATOR SYSTEM

[75] Inventors: Emanuel E. Enriquez, West Caldwell; Marjorie J. Polis, Morris Township, Morris County, both of N.J.

[73] Assignee: Westinghouse Electric Corp., Pittsburgh, Pa.

[21] Appl. No.: 447,059

[22] Filed: Dec. 6, 1982

[51] Int. Cl.[3] ..... B66B 1/18

[52] U.S. Cl. ..... 187/29 R

[58] Field of Search ..... 187/29

[56] References Cited

U.S. PATENT DOCUMENTS

| | | | |
|---|---|---|---|
| 4,111,284 | 9/1978 | Winkler et al. | 187/29 |
| 4,124,102 | 11/1978 | Doane et al. | 187/29 |
| 4,193,478 | 3/1980 | Keller et al. | 187/29 |
| 4,246,983 | 1/1981 | Bril | 187/29 |

*Primary Examiner*—Ulysses Weldon
*Assistant Examiner*—W. E. Duncanson, Jr.
*Attorney, Agent, or Firm*—D. R. Lackey

[57] ABSTRACT

A plurality of elevator cars under the supervisory control of a dispatcher processor. A communication processor having a plurality of buffers, a memory shared by both the dispatcher processor and communication processor, and an interface between the communication processor and the elevator cars, cooperatively control the flow of information. Car status information, prepared by the elevator cars, is sent to the dispatcher processor via the interface, buffers and shared memory. Car mode information prepared by the dispatcher is sent to the elevator cars via the shared memory, buffers and interface. A semaphore access arrangement speeds up access to the shared memory, and interrupts control transfer of information between the buffers and interface. In the communication process, the dispatcher processor only loads and unloads the shared memory, and the communication processor loads and unloads both the shared memory and the buffers.

33 Claims, 27 Drawing Figures

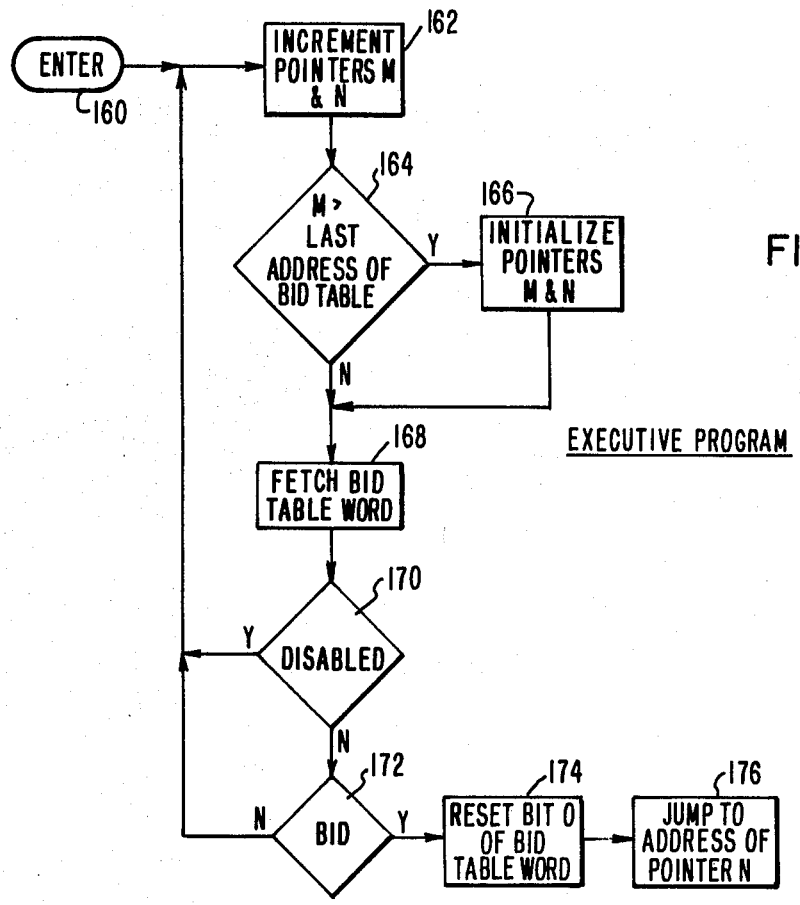
FIG. 5
FIG. 6
BID TABLE
(RAM)
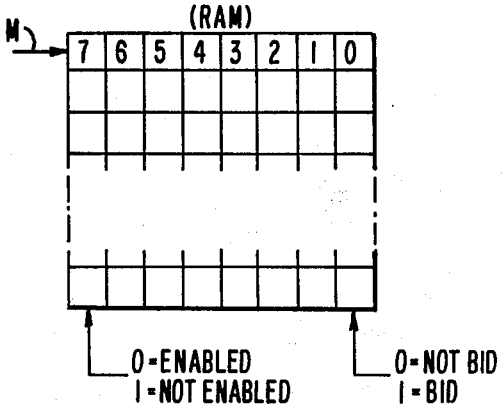
FIG. 7
MODULE ADDRESS TABLE
(ROM)
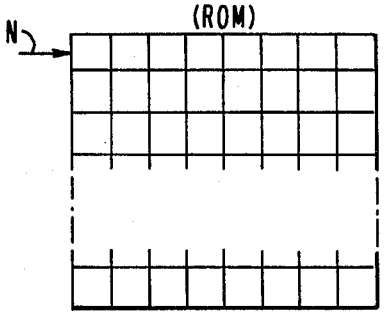

CP PROGRAM

MEMORY ACCESS CP

MASTER SLAVE FUNCTIONAL SEQUENCE

POLLING

SELECTING

ELEVATOR SYSTEM

BACKGROUND OF THE INVENTION

1. Field of the Invention

The invention relates in general to elevator systems, and more specifically to new and improved methods and apparatus for improving the timely interchange of mode (command) and status information between a plurality of elevator cars and a dispatcher processor.

2. Description of the Prior Art

Elevator systems, having a plurality of elevator cars under group supervisory control by a dispatcher function, may utilize a digital computer in the implementation of the dispatcher function. U.S. Pat. No. 3,804,209, which is assigned to the same assignee as the present application, discloses a dispatcher which utilizes a digital computer, with a computer-aided dispatcher function hereinafter being referred to as a dispatcher processor (DP). Suitable operating strategy for the DP is disclosed in U.S. Pat. No. 3,851,733. Individual car control suitable for operating alone, or under group control by a DP, is disclosed in U.S. Pat. No. 3,750,850. These patents, all of which are assigned to the same assignee as the present application, are hereby incorporated by reference, and will be hereinafter referred to as the incorporated patents.

The incorporated patents describe an elevator system in which the DP controls each elevator car via a separate high speed serial data link, and the DP reads the status of each eleveator car via another separate high speed data link. While this is a completely satisfactory arrangement, it does require a computer having a fast cycle time, and having substantial memory, such as a minicomputer.

With the relatively low cost microprocessor now available, it is attractive to use it to construct a still relatively low cost microcomputer, and to use a plurality of microcomputers to perform the tasks formerly provided by electromagnetic relays and/or hard wired logic. This arrangement can greatly reduce the burden placed on the DP, enabling its function to also be provided by a microcomputer. However, a plurality of microcomputers must work together in harmony, without inefficiency or lost time, as it is critical that the car status information prepared by the elevator cars and sent to the DP, relative to their current operating status, be timely, so that the DP strategy is always applied to the situation as it presently exists. Otherwise, the DP signals to the elevator cars which control their operating modes will not be timely, causing inefficiency and poor elevator service to the building. Also, even if the mode control signals prepared by the DP are prepared with the use of timely car status information, these car mode signals must be promptly sent to and received by the elevator cars, or the status of the elevator cars may change appreciably by the time they receive the car mode signals, again causing inefficiency and degraded elevator service.

SUMMARY OF THE INVENTION

Briefly, the present invention is a new and improved elevator system, and method of operating an elevator system, which includes a plurality of elevator cars under the control of a DP. A communication processor (CP), which includes a microcomputer, controls all communication between the DP and the elevator cars.

The DP and CP utilize a shared memory, with access times being reduced to a minimum by a semaphore or flag arrangement which permits shared access to the memory when there is no potential conflict in the memory operations to be performed by the DP and CP.

In general, the CP polls the elevator cars individually for their latest car status information (CSI) over a serial data link with multi-drop configuration, and it also directs car mode information (CMI) prepared by the DP to the elevator cars. When the CP polls an elevator car for CSI, a buffer and interface arrangement make it unnecessary for the CP to "wait" for the requested information.

More specifically, the CP's primary task is to alternately load and unload a plurality of memory locations called buffers. Equitable division of time between obtaining CSI and sending CMI to the elevator cars, as well as equal treatment of all of the elevator cars, is obtained by a Request Table which includes a select request for each elevator car. A select request "selects" an elevator car to receive CMI prepared by the DP. The Request Table also includes a poll request for each elevator car. A poll request polls or asks each elevator car for CSI. The poll and select requests are alternately arranged in the Request Table, which is time efficient, as the CP may "pack" information relative to a select request while an elevator car is responding to a poll request.

A plurality of buffers are utilized, with the number being selected such that by the time the CP sequentially loads all of the buffers with poll and select requests from the Request Table, they will have been unloaded by sending the requests to the elevator cars, and reloaded with the CSI responses to the poll requests. Thus, the CP loads the buffers on one pass, and unloads them on the next.

An interface is provided between the CP and the plurality of elevator cars. The interface provides a first signal when it is ready to transmit CMI to an elevator car, and it provides a second signal when it has asked for and received CSI from an elevator car. These signals are used to interrupt the CP, with appropriate interrupt routines immediately transmitting a poll or select request from a buffer to an identified elevator car via the interface, in response to the first signal, and immediately transferring CSI from the interface to a buffer, in response to the second signal.

Thus, in summary, the CP sequentially loads a plurality of buffers, taking poll and select requests in sequence from a Request Table. When a select request is loaded into a buffer, the CP accesses the shared memory to read the latest CMI for the associated elevator car, and the CP then transfers this CMI to a buffer, storing it in the same buffer as the associated select request. The key to the efficiency of the arrangement is that data transmission is handled asynchronously with respect to the data buffering. While the CP continues to load the buffers, the interface will generate interrupt signals for the CP, resulting in the transmission of the poll and select requests to the elevator cars, as well as the transmission of CMI along with the select requests. The polled elevator cars will also start to respond while the CP is in the process of loading the buffers, sending CSI to the interface, which in turn generates an interrupt for the CP. This interrupt calls a routine which immediately transfers the CSI from the interface to the buffer holding the associated poll request. When the CP completes the loading of the buffers, it returns to the first buffer in the sequence, this time unloading CSI and writing it into the shared memory. The DP reads the latest CSI from the shared memory and prepares CMI for the elevator cars according to its strategy, to efficiently serve calls for elevator service as they are registered. The DP then writes the CMI into the shared memory for use by the CP.

BRIEF DESCRIPTION OF THE DRAWINGS

The invention may be better understood, and further advantages and uses thereof more readily apparent, when considered in view of the following detailed description of exemplary embodiments, taken with the accompanying drawings in which:

FIG. 5 is a flow chart of a priority executive program which may be used by the CP to link program modules together on a need-to-run basis;

FIG. 6 is an exemplary format of the bid table which may be stored in ROM for use by the priority executive program shown in FIG. 5;

FIG. 7 is an exemplary format of a module address table which lists the starting address of each program module which may be placed into bid, and then selected to run, by the priority executive program shown in FIG. 5;

DESCRIPTION OF THE PREFERRED EMBODIMENTS

Figure 1:
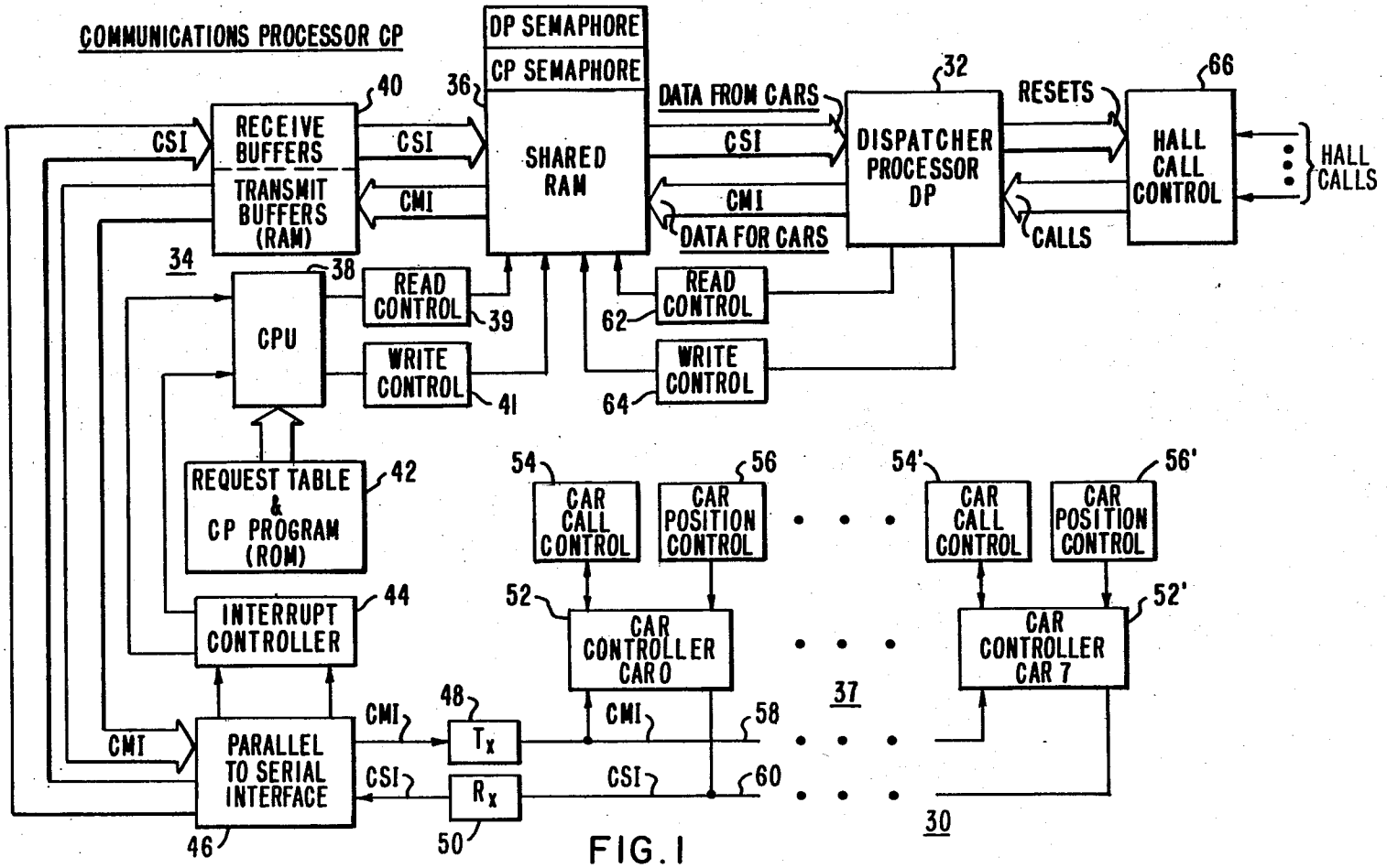
FIG.1 is a functional block diagram of an elevator system constructed according to the teachings of the invention.

Referring now to the drawings, and to FIG. 1 in particular, there is shown a functional block diagram of an elevator system 30 constructed according to the teachings of the invention. Broadly, the elevator system 30 includes a dispatcher processor 32 (DP), which includes a suitable digital computer, a communication processor 34 (CP), a random access memory 36 (RAM), which is shared by the DP and CP, and a plurality of elevator cars, referred to generally with reference 37.

CP 34 includes a central processing unit 38 (CPU), read and write control 39 and 41, respectively, for enabling CP 34 to utilize the shared memory 36, a random access memory 40 (RAM), which includes a plurality of buffers which will be referred to broadly as "receive" and "transmit" buffers, a read-only memory 42 (ROM), which includes the CP program modules and a Request Table, an interrupt controller 44, a parallel-to-serial interface 46, and drivers and receivers 48 and 50, respectively, which communicate with the elevator cars 37. Driver 48 includes a transmit buffer, and receiver 50 includes a receive buffer.

Each of the plurality of elevator cars, shown generally at 37, include similar apparatus, with only car 0 and car 7 of an eight car bank being shown. For example, car 0 includes a car controller 52, which includes such functions as the floor selector, speed pattern generator, door operator, hall lantern control and drive motor control. Car call control 54 includes the car call station for passengers to register car calls. Suitable car position control 56 enables the floor selector to keep track of the car position. In like manner, car 7 includes a car controller 52', car call control 54' and car position control 56'.

In general, data between the interface 46 and the elevator cars 37 is preferably handled serially, with separate serial data links 58 and 60 handling data to and from the elevator cars, respectively. The remaining data transfers are via parallel data buses.

The DP includes read and write control 62 and 64, respectively, for accessing the shared memory 36. Suitable hall call control 66 is also provided, which includes the up and down hall call pushbuttons for registering calls for elevator service. The hall calls are directed to the DP 32 via the hall call control 66.

Broadly, CP 34 writes car status information (CSI) into the shared memory 36, DP 32 reads the shared memory 36 to obtain CSI. DP 32 prepares car mode information (CMI) for the elevator cars, using CSI, the hall calls and its built-in strategy, which information directs the elevator cars 37 to serve the registered hall calls according to the strategy. DP 32 writes CMI into the shared memory 36, and CP 34 reads the shared memory 36 to obtain CMI for the elevator cars 37.

The shared memory 36 includes a logical construct called a "semaphore" (or flag) for each of the DP and CP, referred to as DP and CP semaphores, respectively. A semaphore is a byte in shared memory 36. When DP or CP wishes to access the shared memory 36, it checks the semaphore of the other. When DP or CP accesses memory 36 and it has not already been accessed by the other, i.e., the semaphore of the other is set to a value which indicates "not accessing", it sets its own semaphore to a value which indicates the nature of the intended memory operation. In other words, it sets its semaphore to a value which indicates whether the memory operation is to be a memory read, or a memory write. As will be hereinafter described in detail, the value to which the semaphore is set may also indicate which of the plurality of elevator cars the memory operation concerns. When the DP or CP wishes to access memory 36, and it finds the semaphore of the other set to a value which indicates "in use", it does not automatically wait until the other processor has finished with the complete memory operation. It compares the memory operation being performed by the other processor with its own intended memory operation. if there is no potential conflict, it proceeds with its access of the memory. Only when a potential conflict exists, does one processor wait for the other processor to completely finish the memory access and reset its semaphore to "not accessing", before proceeding with its own memory operation. In other words, if there is no potential conflict in memory operations, when one processor finishes a memory cycle, the other processor may access the memory for one or more memory cycles, depending upon which processor has a higher priority in gaining access to the shared memory.

A potential conflict exists when one processor would like to read data which is being updated or rewritten by the other processor. This might cause the reading of a combination of old and new data. Thus, a processor which desires access to the shared memory and finds it "in use", might compare memory operations, and continue with its accessing if the memory operations are both "read", or both "write". If they are found to be both read and write operations, the second processor would wait until the first processor has completely finished the memory operation, even if the second processor has a higher priority in gaining access to the shared memory. In a preferred embodiment of the invention, the semaphores also identify the elevator car involved in the memory operation. In this embodiment, upon finding a read-write combination, the processor desiring access to the memory would then check to see if both memory operations concern the same elevator car. If they do not involve the same elevator car, the second processor would proceed with its accessing of the memory. Only when the read-write combination concerns the same elevator car would the other processor wait until the accessing processor completely finishes its memory access.

To further speed the preparation and transfer of CMI and CSI between the DP 32 and the elevator cars 37, CP 34 is arranged such that its primary function is to merely load and unload the buffers 40. It does not have to prepare a select request for a specific car, pack it with the latest CMI for this elevator car, wait for the data link to the elevator car to be free, and wait for the car itself to be free to respond, transmit the data, and then prepare a poll request. Normally, in a poll request, the elevator car would have to perform all of the functions enumerated for the select request, and also include the function of waiting for the polled elevator car to respond. As indicated in FIG. 1, there may be separate "transmit" and "receive" buffers, with CP 34 loading the transmit buffers with select and poll requests for transmission to the elevator cars, and the CSI from the cars may be stored in the "receive" buffers, which are unloaded by CP 34. In a preferred embodiment, the buffers are all used to transmit, and they are all used to receive, depending upon the CP program at any instant. In this preferred embodiment, the CP initially goes through all of the buffers in a predetermined sequence to load them with poll and select requests, and then, continuing to scan the buffers in the same sequence, loading empty ones with a poll or select request, according to the next one in the Request Table, and unloading buffers which are found to be filled with CSI. This loading and unloading of the buffers by the CP is cyclic, running in a continuous sequence once the program module is selected by a priority executive to run. The buffers are also unloaded and loaded in response to predetermined signals from interface 46, which signals are applied to the interrupt controller 44. The interrupt controller 44 generates interrupt signals for CPU 38. When the transmit buffer in driver 48 is empty, interface 46 provides a first signal for controller 44. Controller 44 generates an interrupt and CPU 38 interrupts its program to run a first interrupt routine which causes the transmission of the data from a buffer which is ready to transmit information to the elevator cars. The data is placed on the parallel data bus, and latched by interface 46. Interface 46 serializes the information, it alerts the elevator car the data is destined for, and it sends the data to the car in a serial stream, after the elevator car acknowledges that it is ready to receive data.

After an elevator car receives a poll request, it transmits its CSI serially, which is received by the receive buffer in receiver 50. Interface 46 then provides a second signal for interrupt controller 44, indicating that it has CSI ready for transmission. Interrupt controller 44 generates an interrupt and CPU stops the program it is running, and runs a second interrupt routine which causes the data in the receive buffer of the interface 46 to be transferred to the buffer holding the associated poll request.

Figure 2A:
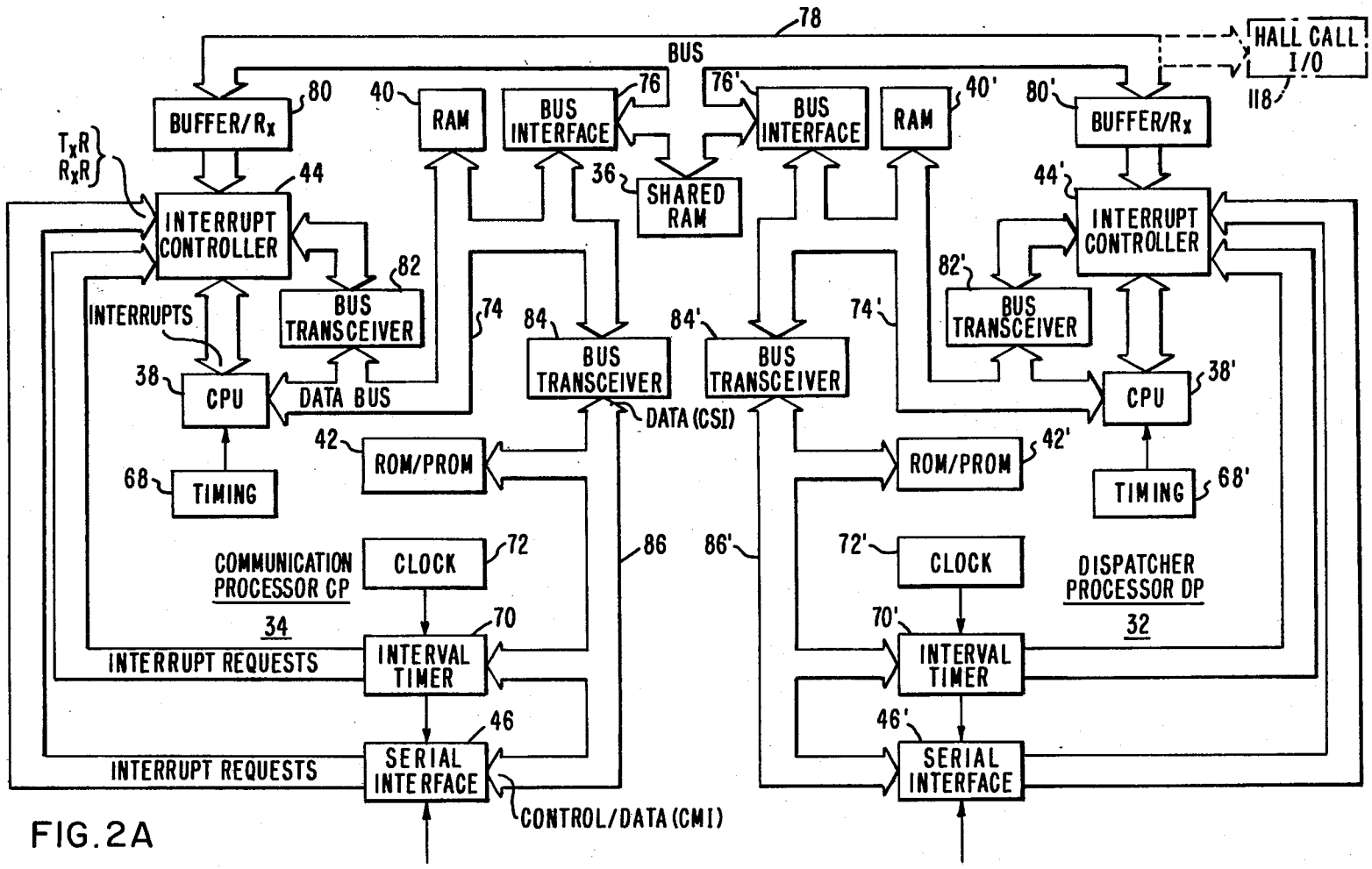
FIG. 2A and 2B may be assembled to provide a detailed block diagram of an exemplary embodiment of the invention.
Figure 2B:
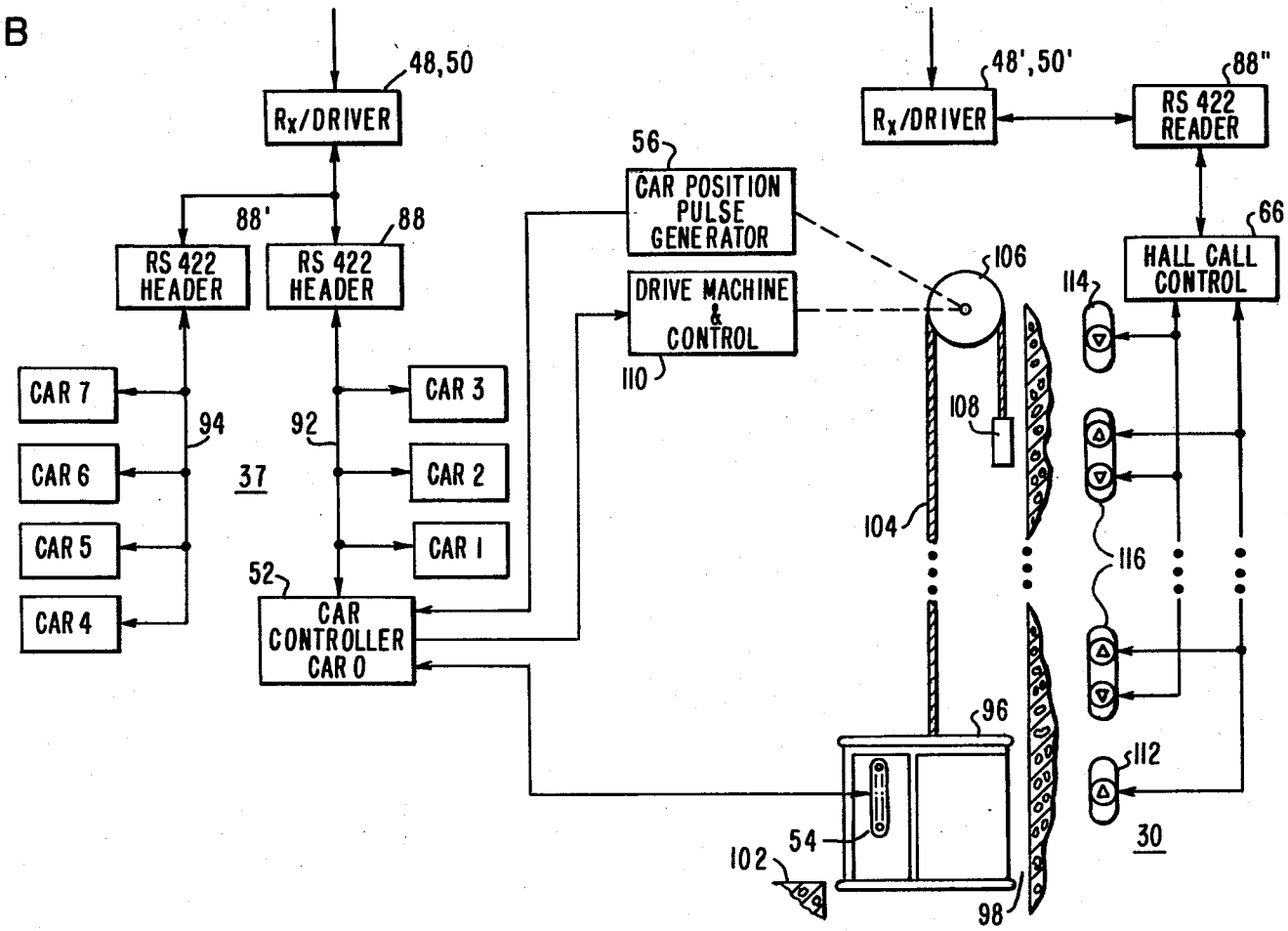

FIGS. 2A and 2B may be assembled to provide a detailed block diagram of an exemplary embodiment of the elevator system 30 shown in FIG. 1. Like functions in FIGS. 1, 2A and 2B are identified with like reference numerals. The CP and DP are microcomputers, such as Intel's iSBC 80/24 TM single board computer. The CPU 38 is Intel's 8085A microprocessor which is connected to a timing function 68. The timing function 68 may include a clock, such as Intel's 8224. The interrupt controller 44, which may be Intel's 8259A, provides interrupts for CPU 38 in response to, among other things, interrupt request lines $T_xR$ and $R_xR$ from the serial interface 46. The serial interface 46, which may be Intel's 8251A, provides a true interrupt request on line $T_xR$ when it is ready to transmit CMI to an elevator car, and a true interrupt request on line $R_xR$ when it has received CSI from an elevator car. An interval timer 70, such as Intel's 8253, and clock 72, such as Intel's 8224, provide timing for interface 70, and additional interrupt requests for controller 44.

CPU 38 communicates with the shared memory 36 via a 16 bit address/data bus 74 (AD0-AD15), a bus interface 76, and a system bus 78. System bus 78 is in common with memory 36 and DP 32, and is also referred to as the common bus.

Interrupt controller 44 can receive information from the system bus 78 via a buffer/receiver 80, such as T.I.'s 74LS240, and it is in communication with the address-/data bus 74 via a bus transceiver 82, such as Intel's 8287. A similar bus transceiver 84 separates bus 74 from a bus 86. Bus 86 is connected to the serial interface 46, the interval timer 70 and the ROM 42.

The apparatus located between interface 46 and the elevator cars 37 includes the driver 48 and receiver 50, RS422 headers 88 and 90, and serial data links 92 and 94. Clock 72, interval timer 70, serial interface 46, driver 48, receiver 50, and headers 88 and 88' may be mounted on a separate board, such as Intel's iSBX 351 TM Serial Multimodule TM Board, which may be plugged into the 80/24 board. The driver 48 and receiver 50 may be quad RS422 driver (Motorola's MC34878), and quad RS422 receiver (Motorola's MC 34868), respectively. Each of the elevator cars, such as elevator car 0, in addition to the car controller 52, includes an elevator cab 96 mounted for vertical, guided movement in the hoistway 98 of a building 100 to serve the floors therein, such as the floor indicated by reference numeral 102. For example, if elevator system 30 is a traction elevator system, cab 96 may be connected to a plurality of wire ropes 104, which are reeved over a traction sheave 106 and connected to a counterweight 108. Sheave 106 is driven by a traction drive machine 110, which is under the control of the car controller 52. The car position control 56, as illustrated, may develop distance pulses in response to the pulse wheel (not shown) which rotates when the elevator cab 96 moves. A pulse is generated for each predetermined standard increment of car movement, such as a pulse for each 0.25 inch of car movement. The car controller counts the pulses, incrementing and decrementing the count according to travel direction, and it compares the count with the address of the floors of the building, which addresses are also in the terms of a pulse count, describing the location of the floor relative to the bottom floor. The bottom floor would have a pulse count of zero.

Hall calls, which may be produced by hall buttons located at the floors of building 100, such as the up pushbutton 112 located at the lowest floor, the down pushbutton 114 located at the highest floor, and up and down pushbutton combinations 116 located at the intermediate floors, may be serialized by hall call control and directed through an RS422 header 88'', a receiver 50' and then to the serial/parallel interface 46'. Alternatively, the hall calls may be brought into the common bus 78 in parallel through a separate I/O board with this option being indicated by the hall call I/O function 118 shown in broken outline in FIG. 2A.

Figure 3A:
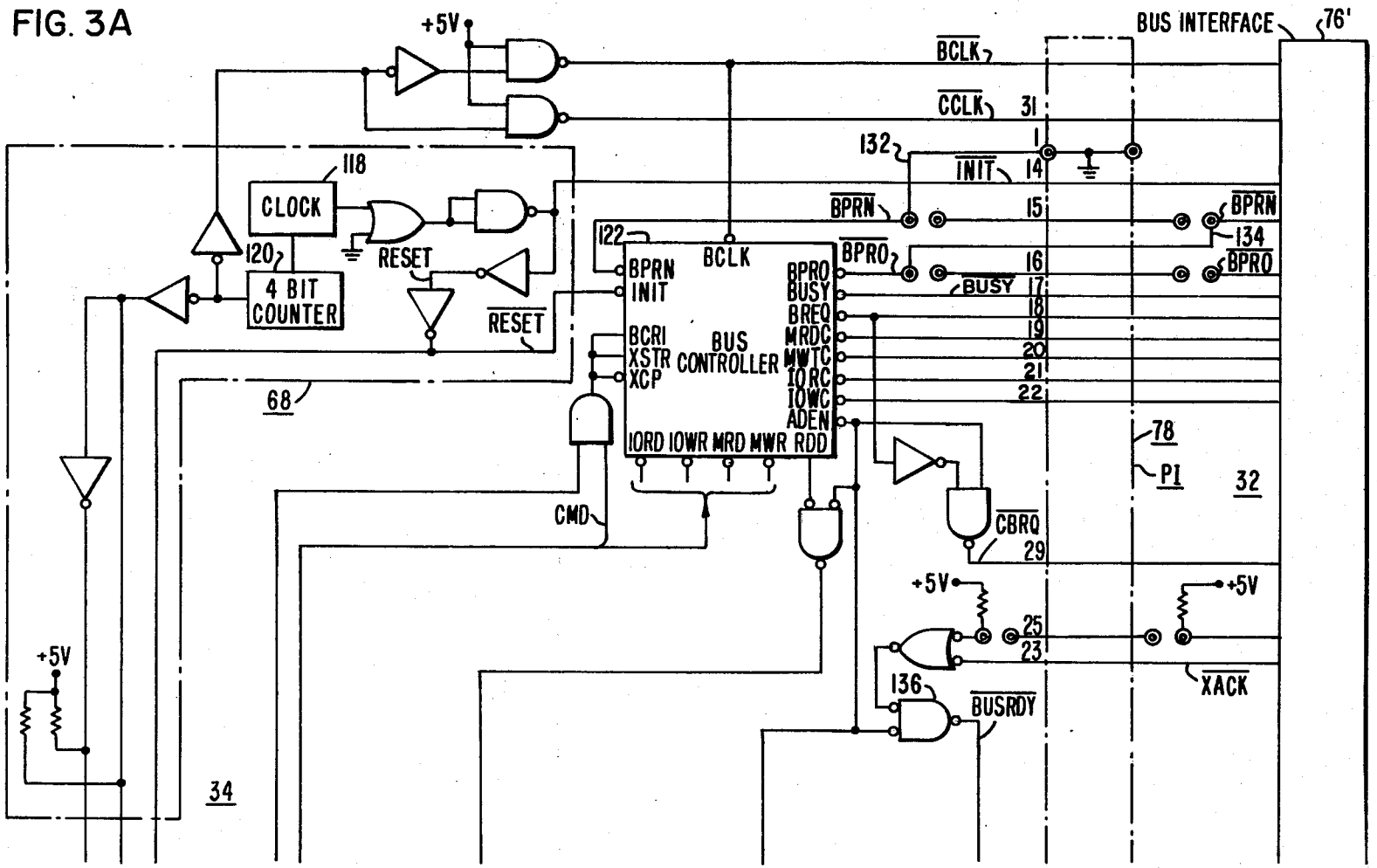
FIGS. 3A, 3B and 3C may be assembled to provide a detailed schematic diagram of certain of the block functions shown in FIG. 2, including the bus interface.
Figure 3B:
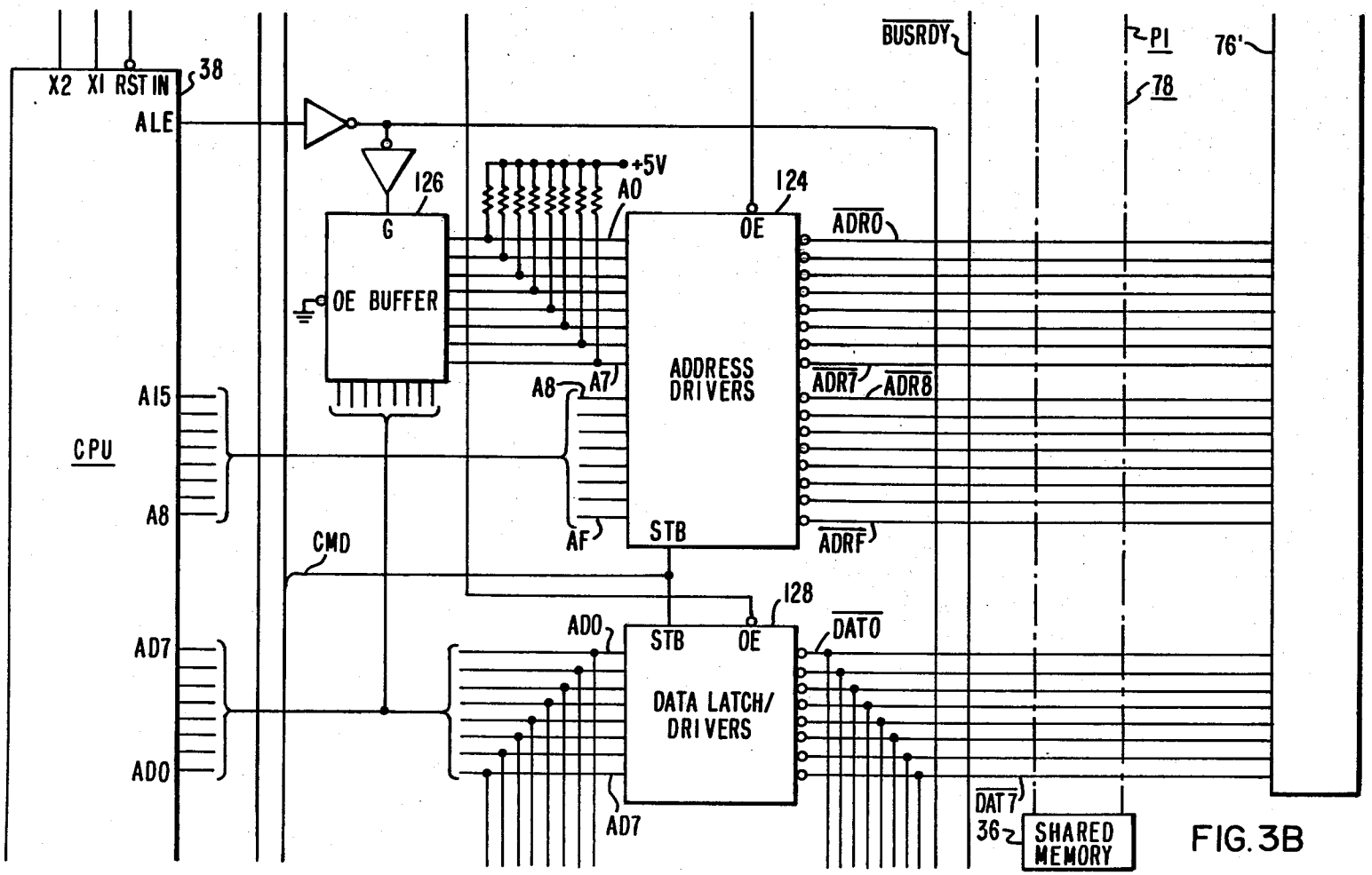
Figure 3C:
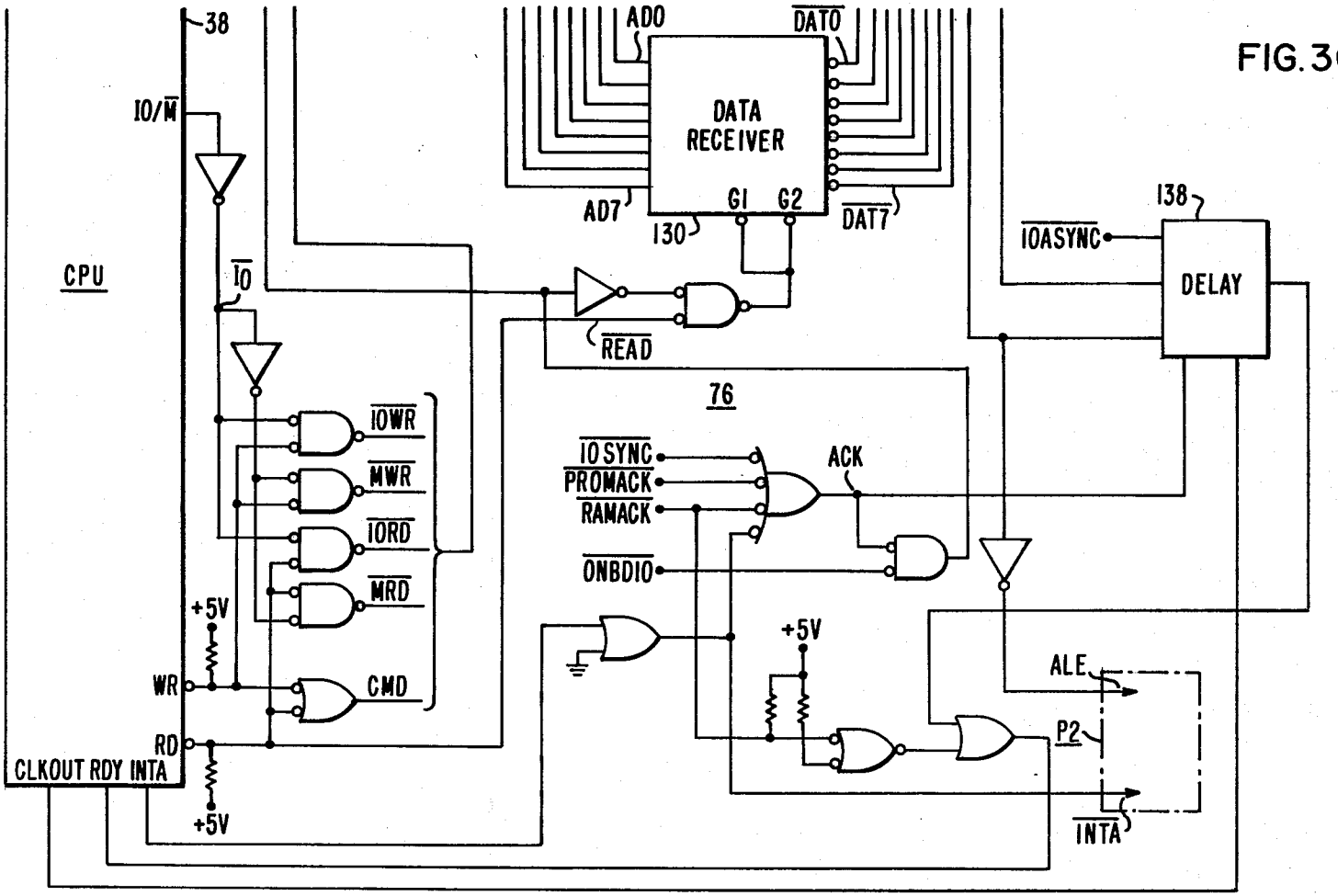

FIGS. 3A, 3B and 3C may be assembled to provide a detailed schematic diagram of bus interface 76, system bus 78, timing 68, CPU 38, and the priority selecting interconnection between CP 34 and DP 32. Bus connector P1, and an auxiliary connector P2, form the common bus 78 which interconnects CP 34, DP 32 and shared memory 36, as well as any other boards in the system. These connectors also connect the various boards of the system to the power supply.

The timing function 68 includes a clock 118, such as Intel's 8224, a 4-bit counter 120, and a plurality of gates, which provide a 4.8 MHz timing signal for the X1 and X2 inputs of CPU 38, and a reset signal $\overline{RESET}$, used for initialization upon power-up. An output of counter 120 is used to provide the bus clock and continuous clock signals $\overline{BCLK}$ and $\overline{CCLK}$, respectively, for the common bus 78. CP 34 is selected as the master controller, and it accordingly provides the common bus timing. Signals $\overline{BCLK}$ and $\overline{CCLK}$ generated in bus interface 76', which is part of DP 32, are not brought off-board.

Bus interface 76 includes a bus controller 122, address drivers 124, buffer 126, data latch/drivers 128, and a data receiver 130. Bus controller 122 arbitrates requests by its own board for use of the system or common bus 78. When control of the system bus 78 is acquired, the bus controller generates a memory read signal $\overline{MRDC}$, a memory write signal $\overline{MWTC}$, an I/O read signal $\overline{IORC}$, or an I/O write signal $\overline{IOWC}$, according to commands $\overline{MRD}$, $\overline{MWR}$, $\overline{IORD}$ and $\overline{IOWR}$, respectively, produced by CPU 38. Bus controller 128 then gates the address of the memory or I/O device onto the address lines $\overline{ADR0}$-$\overline{ADRF}$, it provides a true output signal $\overline{ADEN}$ to input OE of the address drivers 124, and it gates data from CPU 38 onto the data bus $\overline{DAT0}$-$\overline{DAT7}$, using its RDD and $\overline{ADEN}$ outputs, which are connected to input OE of the data latch/drivers 128.

An off-board memory or I/O request by CPU 38 provides signals for the BCRI (bus request) and XSTR (transfer start request) inputs of bus controller 122, which starts the bus arbitration in synchronism with the bus clock signal $\overline{BCLK}$. The bus priority is established, making CP 34 the master board and thus a higher priority then DP 32, by connecting input $\overline{BPRN}$ (bus priority in) of bus controller 122 to ground, as shown by jumper 132, and by connecting its output $\overline{BPRO}$ (bus priority out) to the $\overline{BPRN}$ input of interface 76', as shown by jumper 134. Output terminal $\overline{BPRO}$ of interface 76' is not used. The master board or CP 34 is able to acquire control of the common bus 78 any time it is not busy, since its $\overline{BPRN}$ input is always true. When CP 34 requests control of the system bus 78, bus controller 122 drives its output $\overline{BPRO}$ high, which, being connected to the $\overline{BPRN}$ input of the DP's bus controller 76', inhibits this input. Bus controller 122 uses its output $\overline{BUSY}$ to lock and unlock the system bus 78. A low signal $\overline{BUSY}$ locks the CP 34 onto the bus 78 by prohibiting any other board from acquiring control of the bus. The address and data enable output $\overline{ADEN}$ is also driven low when control of the system bus 78 is obtained. When an external acknowledge signal $\overline{XACK}$ is received from the addressed device, gate 136 generates a true signal $\overline{BUSRDY}$, which is applied to CPU 38 at input RDY via a delay circuit 138.

When the bus transaction is complete, signals CMD, ACK and ONBDIO go inactive, causing the transfer input $\overline{XCP}$ of bus controller 122 to go true. When the master (CP 34) does not want the system bus 78, its $\overline{BPRO}$ output goes low and this low input to $\overline{BPRN}$ of bus interface 76' gives DP 32 the opportunity to use bus 78.

Figure 4:
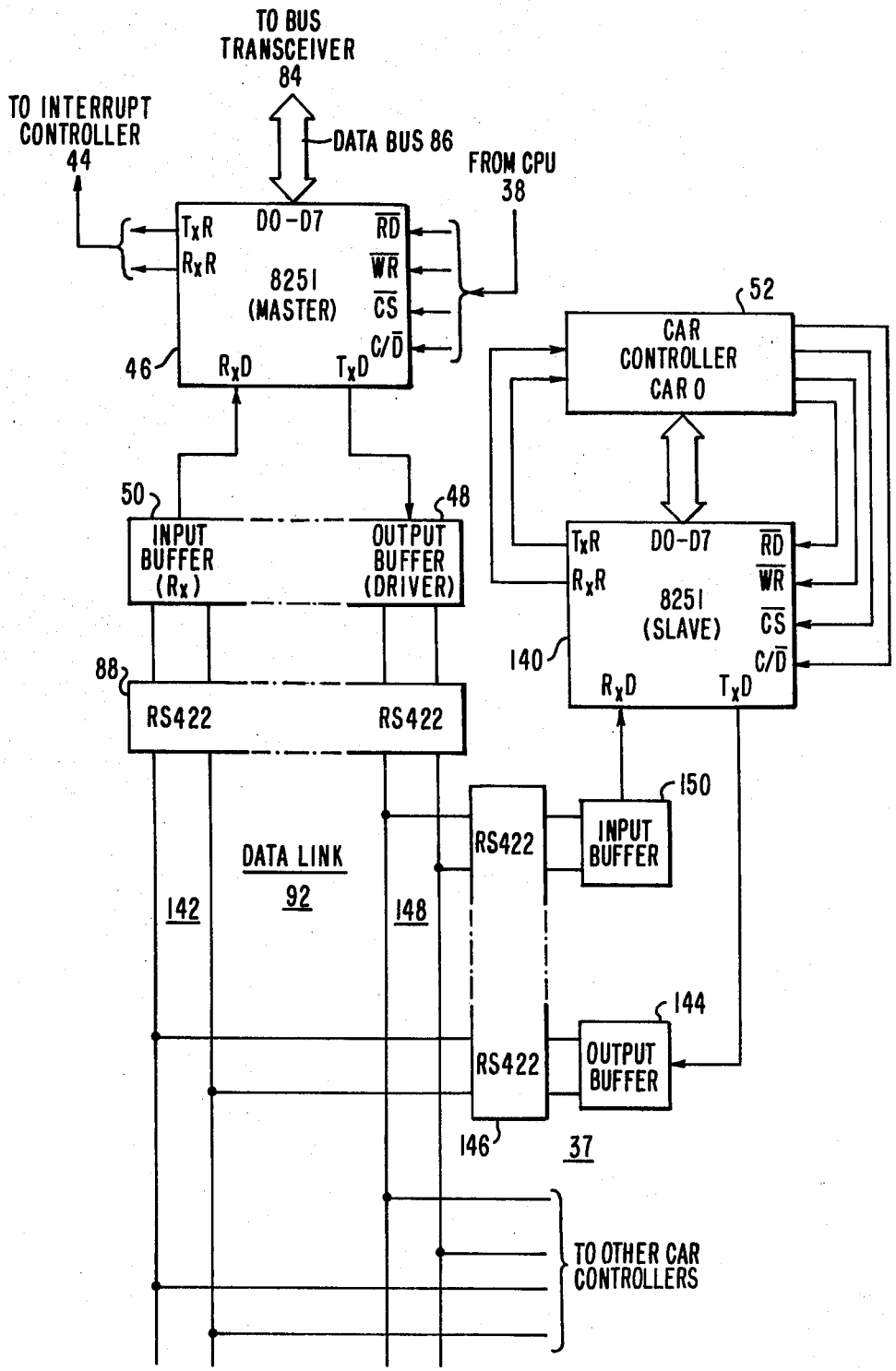
FIG. 4 is a detailed schematic diagram of the serial data link shown in block form in FIG. 2.

FIG. 4 is a schematic diagram of a suitable serial data link which may be used to implement data link 92 shown generally in FIG. 2. Each elevator car, such as car 0, includes a parallel-to-serial interface 140, such as Intel's 8251, with interface 46 being a master and the car interfaces being slaves. The transmit output $T_xD$ of interface 140 is connected to the data link 142 which transmits CSI via an output buffer 144 and an RS422 header 146. Data link 142 is connected to the receive input $R_xD$ of interface 46, via RS422 header 88 and the input buffer 50. The receive input $R_xD$ is connected to data link 148, over which select and poll requests, and CMI, are transmitted to the elevator cars 37 via RS422 header 146 and an output buffer 150. Output $T_xD$ of interface 46 is connected to data link 148 via the output buffer 48 and RS422 header 88. A suitable serial communication protocol will be hereinafter described.

FIGS. 5, 6 and 7 illustrate an exemplary format for controlling the sequence of program execution. Certain of the programs are in the form of modules, and they are only run when there is a need to run them, and then they are run according to a predetermined priority sequence. When a need to run for a particular module is detected, such as by another module, the program is placed in bid. A module may also place itself in bid, at the completion of its running. If a program detects that another module should not run, even when placed in bid, this program or module can disable such other module. The program for linking modules which have been placed in bid in a predetermined priority order, is called the priority executive program, and it is shown in FIG. 5. Each module has an address in RAM 40, called a Bid Table. A suitable format for the Bid Table is shown in FIG. 6. Each module is a program stored in ROM 42, with each module having a predetermined starting address. When the executive program wishes to run a module, it jumps to the starting address of the module in ROM 42. The starting addresses of all modules are grouped together at a predetermined location in ROM 42, to form a Module Address Table. A pointer M points to bid table entries in the Bid Table, and a pointer N points to module address entries in the Module Address Table.

The executive program, shown in a detailed flow chart form in FIG. 5, is entered at a predetermined starting address in ROM 42, which is shown generally at 160 as the "start" terminal. Each module, when it completes its run, returns to this starting address. Step 162 increments pointers M and N, since pointers M and N will point to the bid table entry and starting address for the last module run. Incrementing the pointers thus brings the executive program to the next module in the priority order. The priority order is established by the listing order, with the highest priority module being the addresses to where the pointers are initialized during initialization of the system. Step 164 determines if the complete Bid Table has been checked. If it has, step 166 initializes pointers M and N to the location of the highest priority module. If step 164 finds the Bid Table has not been completely traversed, step 168 fetches the bid word at pointer M so it can be checked, to see if the associated module is enabled, and if so, whether or not this module has been placed in bid. As illustrated, bit position 7 of the bid table word may be tested to check enablement, and bit position 0 may be checked to see if the program has been placed in bid. Accordingly, step 170 checks to see if bit position 7 of the bid table word is a logic zero or a logic one. If a logic one, the module has been disabled and the program returns to step 162 to check the next module in the bid table sequence. If a logic zero, the module has not been disabled, and step 172 checks bit position 0 of the bid table word to see if the module has been placed in bid. If it is a logic zero, it has not been bid, and the program returns to step 162. If this bit position is a logic one, it has been placed in bid, step 174 resets bit position 0, and step 176 jumps to the address in ROM 42 which pointer N of the Module Address Table is pointing to. When this module completes its run, it returns to the starting address 160 of the executive program, as hereinbefore described.

FIGS. 8A, 8B, 9, 10A, 10B and 11 illustrate a desirable feature of the invention which relates to the manner in which CP 34 operates to facilitate transfer of CMI from DP 32 to the elevator cars 37, and the transfer of CSI from the elevator cars 37 to DP 32, eliminating time-consuming "wait" states on the part of CP 34. During the time CP 34 would normally be idle, such as while waiting for information from an elevator car that it has polled, and waiting for communication links to become free, the present invention enables CP 34 to be performing other essential tasks, to substantially shorten the time which CMI and CSI has to wait before being processed.

Figure 8A:
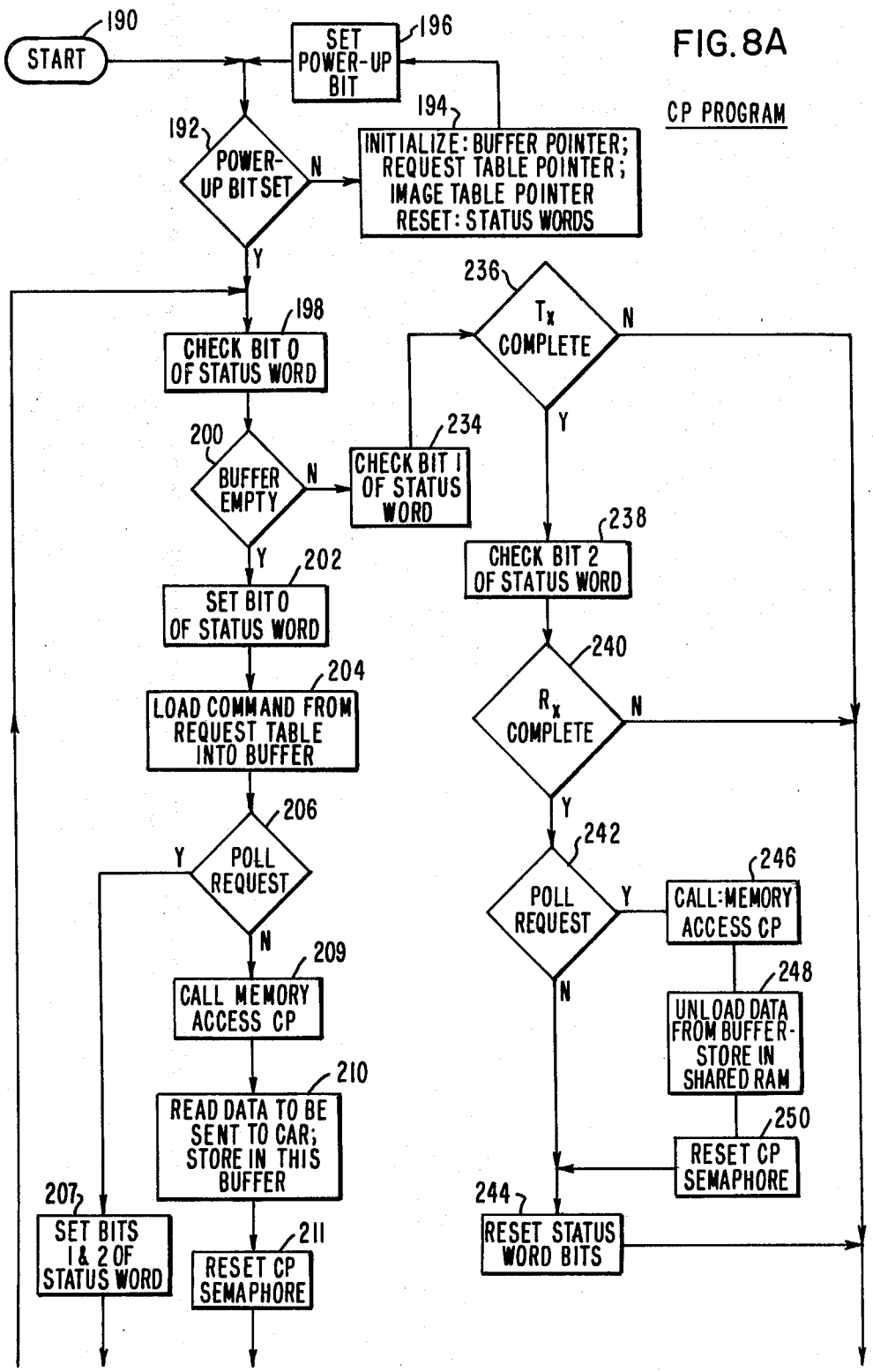
FIGS. 8A and 8B may be assembled to provide a flow chart of the CP program which loads and unloads a plurality of buffers.
Figure 8B:
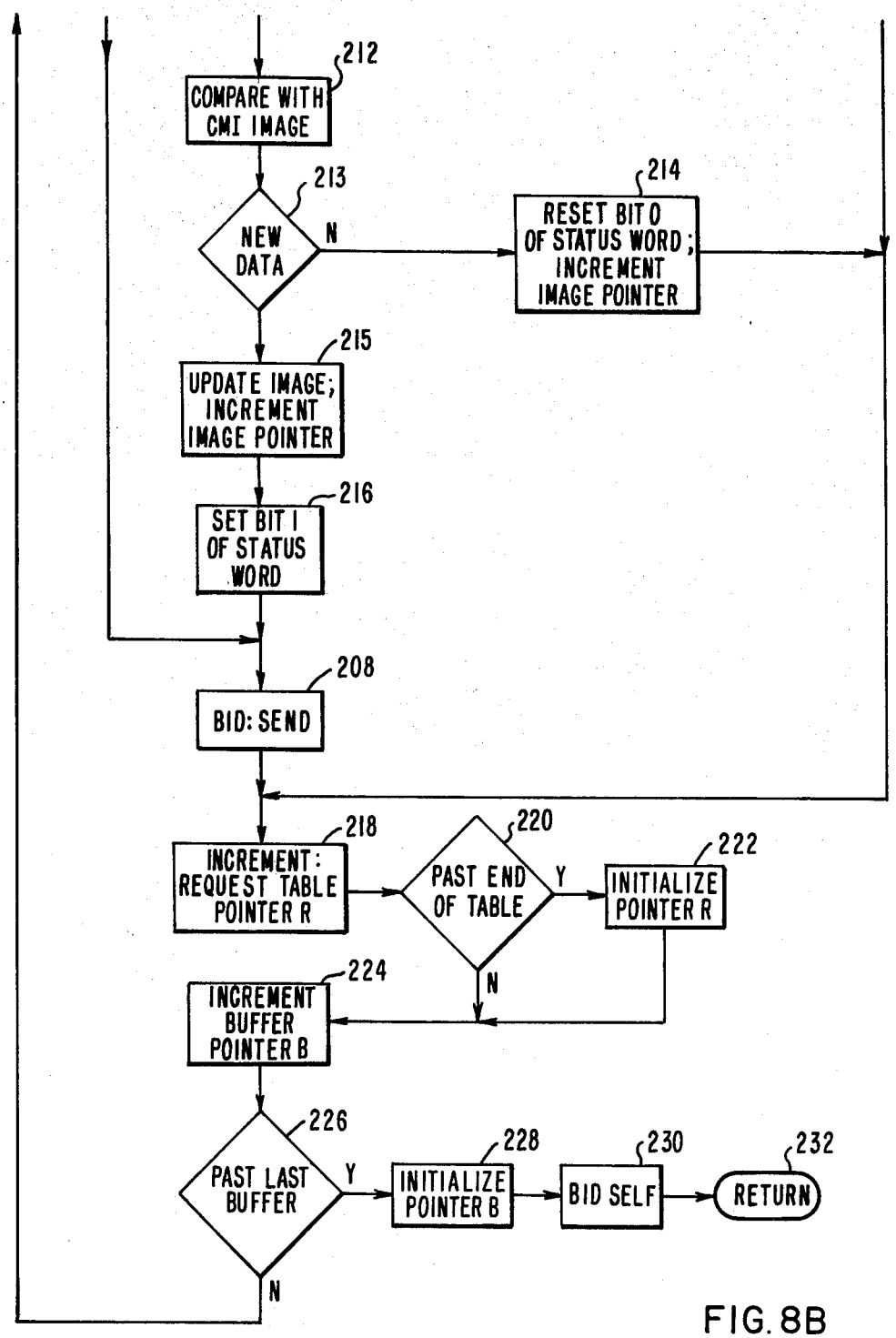
Figure 9:
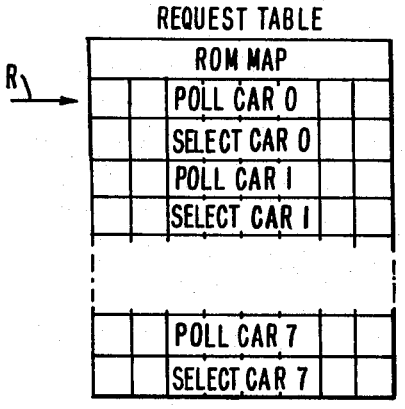
FIG. 9 is an exemplary format of a Request Table which may be stored in ROM and used by the CP during the running of the program shown in FIG. 8.

More specifically, FIGS. 8A and 8B may be assembled to provide a flow chart which sets forth the main program of CP 34. FIG. 9 is a Request Table stored in ROM 42 which contains all of the communication functions to be performed by CP 34. For example, each elevator car has to be polled or asked to supply its latest car status information (CSI), and each elevator car has to be selected to receive the latest car mode information (CMI) prepared by DP 32. Suitable formats and data for CMI and CSI are set forth in detail in incorporated U.S. Pat. Nos. 3,804,209, and thus need not be described in detail. CSI is listed in input words IW0, IW1 and IW2, shown in FIG. 20 of this incorporated patent, and CMI is listed in output words OW0, OW1 and OW2, shown in FIG. 22 of this incorporated patent.

Thus, the Request Table contains entries for polling and selecting each elevator car. A pointer R is moved from entry to entry as each request is processed. In a preferred embodiment, the poll and select requests alternate in the Request Table. Thus, the first entry may be "poll car 0", the next entry may be "select car 0", etc., until poll and select requests for each elevator car in the system have been listed.

Figure 11:
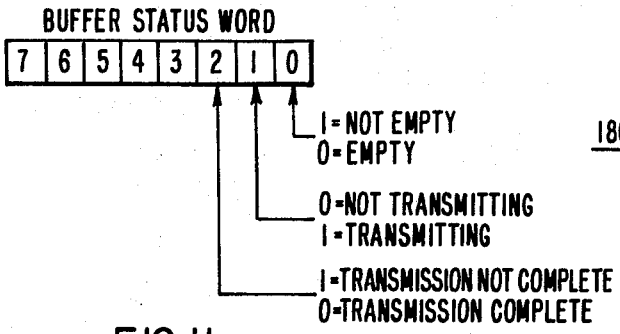
FIG. 11 is an exemplary format for each buffer status word shown in FIG. 10.
Figure 10B:
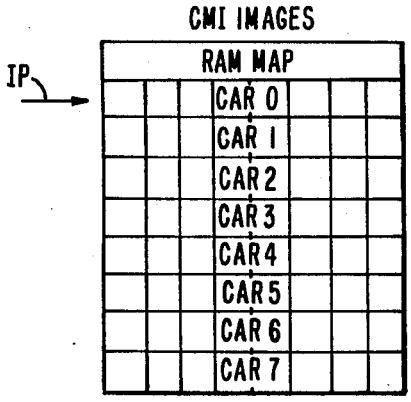
FIG. 10B is a RAM map which illustrates a CMI image table which maintains images of the latest CMI sent to the elevator cars.
Figure 10A:
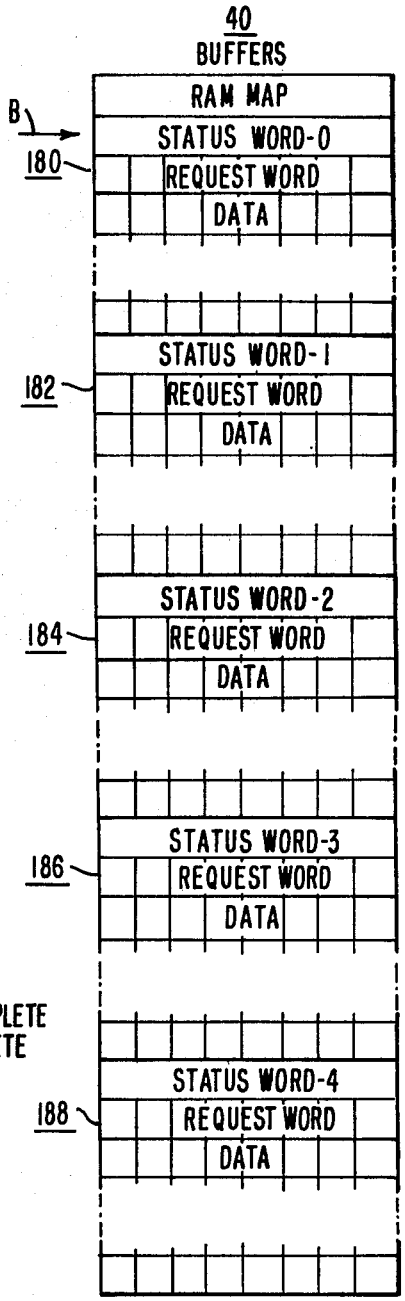
FIG. 10A is an exemplary format of a plurality of buffers which may be part of RAM and used by the CP during the running of the program shown in FIG. 8; and also by the interrupt programs shown in FIGS. 12 and 13.

FIG. 10A illustrates a plurality of buffers, such as buffers 0, 1, 2, 3 and 4, referenced 180, 182, 184, 186 and 188, respectively. The buffers, which may be part of RAM 40, are accessed sequentially by the program of FIG. 8, in a predetermined order. The predetermined order may start at buffer 180 and end at buffer 188. The first word or byte of each buffer is a status word for its associated buffer. A pointer B is moved from buffer to buffer by the program of FIG. 8. FIG. 11 sets forth a suitable format for the buffer status word. For example, bit position 0 may indicate whether or not the buffer is empty, bit position 1 may indicate if transmission of data from the buffer to an elevator car has been completed, and bit position 2 may indicate if the process of receiving CSI from a car and storing it in the buffer has been completed.

As shown in FIG. 10B, each command word (CMI) sent to a car is preserved in an image table in RAM 40. A pointer IP is maintained to always point to the car for which a select request is being prepared. The CMI for a car is read from shared memory 36 and compared with its associated image pointed to by IP. If the CMI has changed, the image is updated and the new CMI is sent to the car. If the CMI has not changed, time is saved by simply going to the next entry in the request table.

The CP program shown in FIGS. 8A and 8B starts at an address in ROM 42 indicated at 190. When the elevator system 30 is placed into operation, the request table pointer R, buffer pointer B and image table pointer IP are initialized, and the buffer status words reset. This is accomplished by steps 192, 194 and 196. Step 192 checks to see if a power-up bit has been set. This may be a bit or word stored in RAM 40. If it is has not been set, step 194 performs the initialization steps and step 196 sets the power-up bit. The program then returns to step 192 which will now find the power-up bit set, and the program proceeds to step 198.

Step 198 fetches the buffer status word located at pointer B, and it tests bit position 0. Step 200 checks the result of the testing of bit position 0, advancing to step 202 if the buffer is found to be empty. Step 202 sets bit 0 of this buffer's status word to a logic one, as the following steps will now load information into this buffer. For example, the next step 204 reads the command or request located at pointer R of the Request Table shown in FIG. 9, and it writes the request into the buffer presently being processed.

Figure 12:
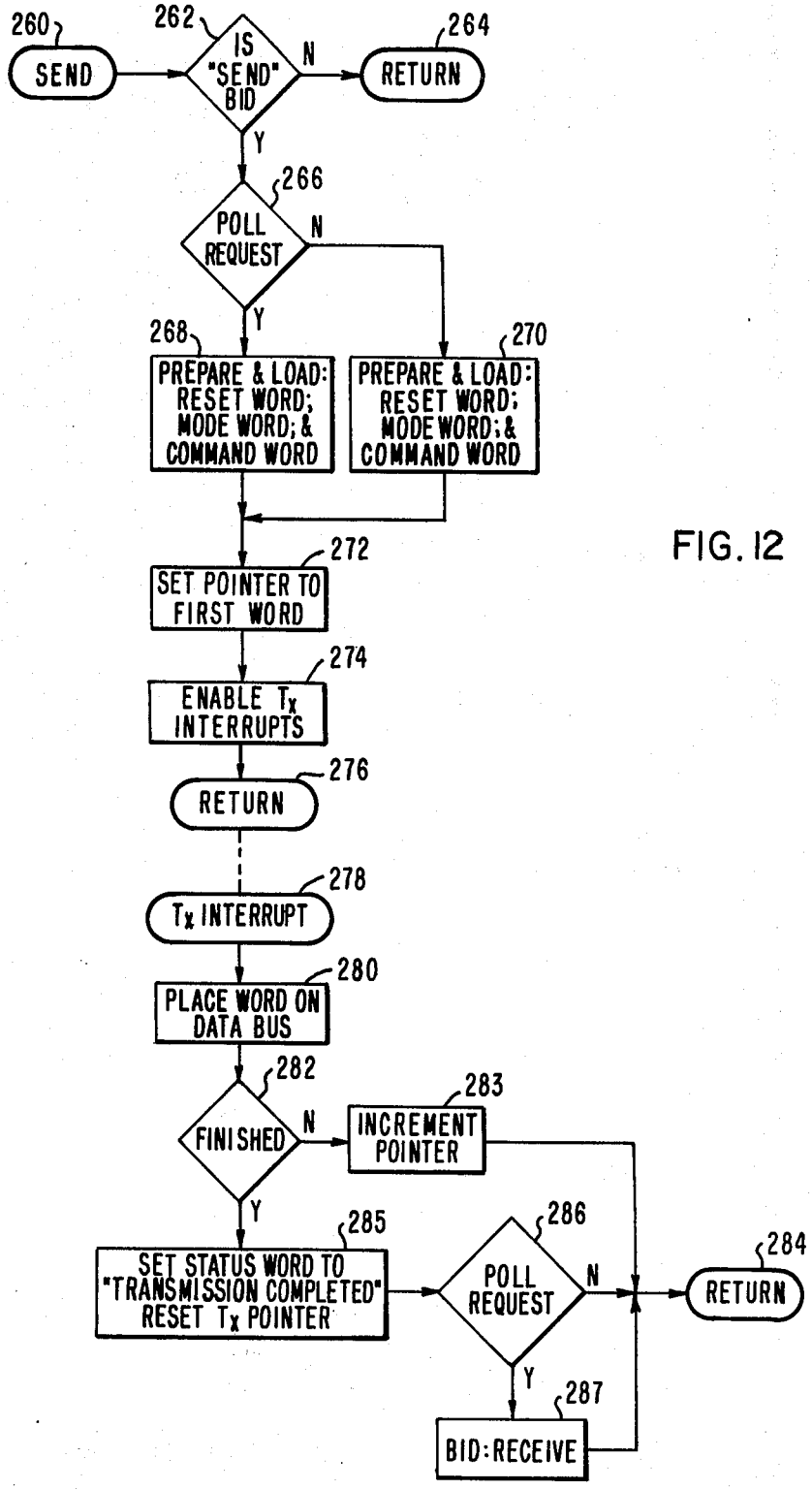
FIG. 12 is a flow chart of a program SEND and an associated interrupt routine, with the latter being run by the CP when the program SEND has enabled the appropriate interrupt, and the interface is ready to transmit information from the buffers shown in FIG. 10 to the elevator cars.

Step 206 determines the nature of a request. If step 206 finds the request to be a poll request, i.e., it is asking a specific car for CSI. Thus, the transaction will require both the transmission of data from the buffer to a car, and the reception of data from the car. Accordingly, step 207 sets bits 1 and 2 of the status word to indicate that both transmission and reception must be completed before the CP should take any further action regarding this buffer. The program then places a program module SEND into bid at step 208. This module is in the Bid Table and will be run in due course by the priority executive after it has been bid. A SEND program and an associated $T_xR$ interrupt program are shown in FIG. 12, and will be hereinafter described.

Figure 14:
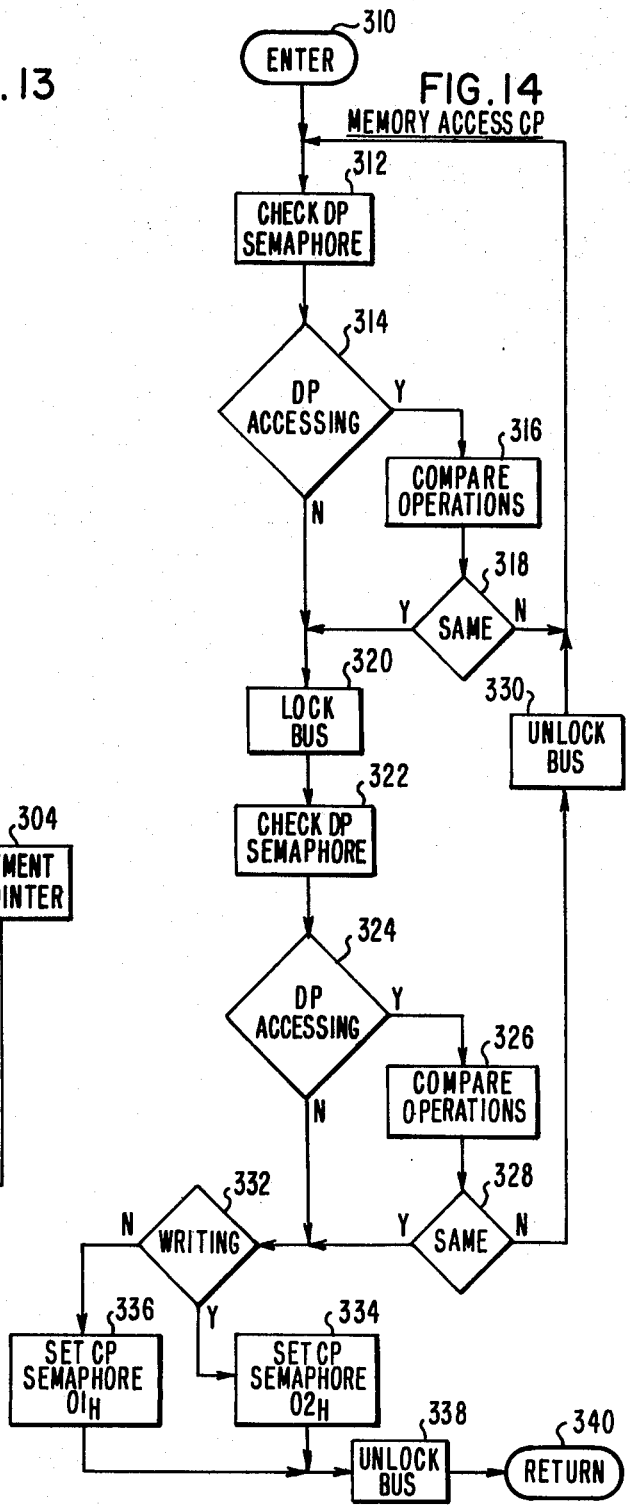
FIG. 14 is a flow chart of a first embodiment of a memory access module which may be called by the CP when it wishes to access the shared memory.

If step 206 finds the request to be a select request, the program goes to step 209, which calls a subroutine "Memory Access CP", whose function is to gain access to the shared memory 36. This subroutine is shown in FIG. 14, and will be hereinafter described. When the subroutine "Memory Access CP" gains access to the shared memory 36, step 210 reads the CMI for the elevator car identified in the select request, which was previously prepared for this car by DP 32 and stored in shared memory 36 during the running of the dispatcher program shown in FIG. 17. The CMI is stored in the buffer being considered. The routine called by step 209 set a CP semaphore shown in FIG. 15, to be hereinafter described, to a value which indicates the nature of the memory access. Step 211 now resets this semaphore to a value which indicates "not accessing".

Step 212 compares the CMI stored in the buffer with the image of the CMI previously sent to this car. This image will be pointed to by pointer IP shown in FIG. 10B. Step 213 tests the result of the comparison to see if the CMI has changed. If it has not changed step 214 resets bit 0 of the buffer status word to indicate the buffer is free to be loaded with data and the image pointer IP is incremented. Step 214 also includes the steps of reinitialing IP when it is incremented past the end of the table. Step 214 then advances to step 218 to start the process of looking at the next entry in the request table.

If step 213 finds the CMI has changed, step 215 updates the image in the table of FIG. 10B, and it increments pointer IP. Step 216 sets bit position 1 of the status word, to indicate that only transmission of the data from the buffer to a car will be required to complete the transaction, and step 208 places program SEND in bid.

Step 208 advances to step 218 which increments the request table pointer R. Step 220 checks to see if the address pointed to is past the end of the table. If so, step 222 initializes the request table pointer R. If pointer R is not past the end of the table, step 220 advances to step 224. Step 222 also proceeds to step 224. Step 224 increments the buffer pointer B. Step 226 checks to see if the pointer is past the address of the last buffer 188. If it is not, step 226 returns to step 198 to process the next buffer. If all buffers have been processed, step 226 advances to step 228 which initializes buffer pointer B, step 230 places itself into bid, and the program returns to the priority executive at 232.

If step 200 finds bit position 0 of the buffer status word is set, i.e., a logic one, indicating it is not empty, step 200 branches to step 234 which checks bit position 1 of the buffer status word. Step 236 tests the results of this check to see if bit position 1 of the status word is set, i.e., "transmission not completed", which means the next operation on this buffer has either not occurred, or is in the process of occurring. If step 236 finds bit position 1 set, it advances to step 218, hereinbefore described.

If step 236 finds bit position 1 reset, i.e., "transmission completed" the information originally placed in this buffer has been sent. The number of buffers may be selected such that by the time the last buffer has been filled with a poll or select request, and packed with CMI when applicable, prior buffers will have already had their information sent to the cars, and at least the first poll request already satisfied with the reception of CSI from the polled elevator car. Thus, on the next pass through the buffers, a buffer will be seldom by-passed because it has not been completely processed. The program of this figure, however, will accommodate any number of buffers, automatically handling unprocessed, partially processed and fully processed buffers. Step 238 then checks bit position 2 of the buffer status word. Step 240 tests the results of this check. If it finds the bit set, i.e., "reception not complete", it was a poll request, and the CSI from the elevator car has not yet been received. Thus, the program advances to step 218. If step 240 finds bit position 2 reset, i.e., "reception complete", all of the operations regarding this buffer have been completed. Step 240 now advances to step 242 which checks the nature of the request word still stored in this buffer. If it is a select request, the CMI has been sent and there is nothing further to do. Thus, step 244 resets the status word bits of this buffer, so step 200, on the next running of the program, will find this buffer empty. If step 242 finds a poll request stored in this buffer, it means the buffer now contains CSI from the polled elevator car. Step 242 then advances to step 246 which calls the memory access routine CP shown in FIG. 14. When step 246 determines that both CP and DP can use the shared memory without conflict, or when the DP has completed its memory access when a potential conflict exists, step 248 unloads the CSI from the buffer and stores it in the shared memory 36. Step 250 then resets the CP semaphore to a value which indicates "not accessing". Step 250 then proceeds to step 244, hereinbefore described.

FIG. 12 is a flow chart of a program SEND which is run by the priority executive after it is placed in bid. FIG. 12 also sets forth a "$T_x$ Interrupt Routine" which CP 34 may be directed to in order to transmit the information stored in the buffers shown in FIG. 10 to the elevator cars 37 via the parallel-to-serial interface 46. Program SEND is entered at its starting address in ROM 42, shown generally at 260. Step 262 may check to make sure SEND has been bid by step 208 of the CP program shown in FIG. 8. If SEND has not been bid, the program returns to the main CP program at 264. If SEND has been bid, step 266 fetches the request stored in the buffer for which SEND has been bid, and it checks its nature. If it is a poll request, step 266 advances to step 268. Step 268 prepares and loads a set of control words into interface 46 to define the transaction to follow. For example, a reset word is sent by writing a command instruction to the address of the interface, which instruction has bit 6 set. This reset word prepares the interface for the mode instruction word, which is prepared and written to the interface address. The mode instruction word defines character length, synchronous or asynchronous operation, baud rate (for asynchronous mode), parity arrangement, and the like. A command instruction word is then prepared and set, which controls the operation of the interface. If step 266 finds a select request, step 266 goes to step 270, which is similar to step 268, preparing and loading the reset, mode and command words for the select request. Steps 268 and 270 both proceed to step 272 which sets a $T_x$ pointer to the first word or character to be transmitted. Step 274 enables transmitter interrupts, and the program returns to the priority executive at 276.

When interface 46 senses that its "transmit buffer" 48 is empty, it generates a signal $T_xR$ which is applied to the interrupt controller 44. $T_xR$ remains true until a character has been loaded into its transmit buffer by CPU 38. The interrupt controller 44, since it has been enabled by step 274, generates an interrupt signal, and CPU 38 interrupts the program it is executing to run the interrupt routine shown in FIG. 12. The routine is entered at its starting address in ROM 42, shown generally at 278, and step 280 writes the data character from the buffer to interface 46, placing the information on the data bus, and step 282 checks to see if all of the characters have been sent. Sending the information from the buffers to the cars does not destroy the data in the buffers. If all of the information has not been sent, the pointer is incremented in step 283, and the routine returns to the interrupted program at 284 to await the next $T_xR$ initiated interrupt. When step 282 finds all data has been sent, step 285 resets bit position 1 of the buffer status word to indicate "transmission completed", it disables transmitter interrupts, and it resets the $T_x$ pointer. Step 286 checks to see if the request was a poll request. If so, step 287 places the program RECEIVE into bid, and exits at 284 to return to the program which was interrupted. If step 286 finds a select request, it goes to exit 284.

Figure 13:
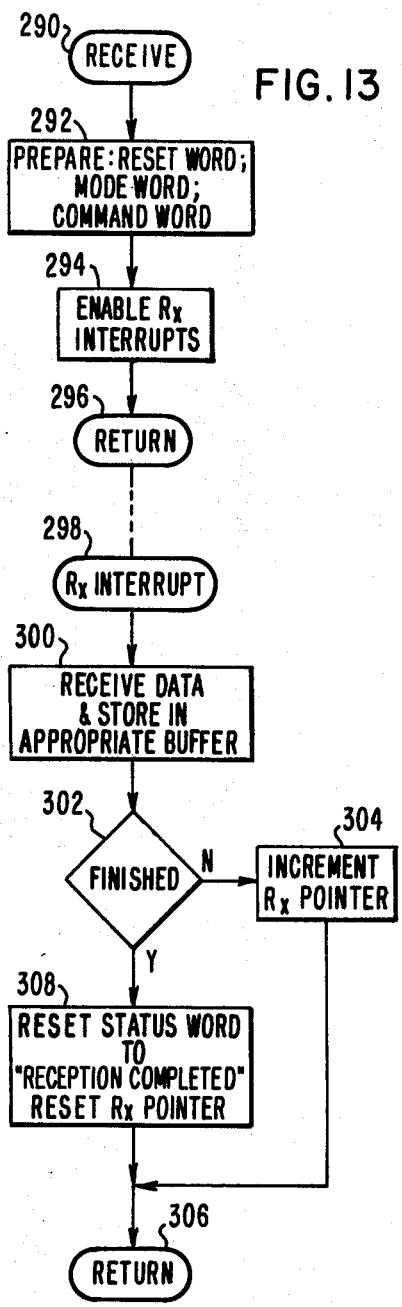
FIG. 13 is a flow chart of a program RECEIVE and an associated interrupt routine, with the latter being run by the CP when the program RECEIVE has enabled the appropriate interrupt, and the interface has received CSI from an elevator car and is ready to transmit it to a buffer shown in FIG. 10.

FIG. 13 is an exemplary flow chart of a program RECEIVE which is run by the priority executive after it is placed in bid. FIG. 13 also sets forth a $R_x$ Interrupt Program which may be used to load a buffer with CSI in response to a poll request. When RECEIVE is placed in bid by step 287 of FIG. 12, the priority executive will run this program, entering the it at point 290. Step 292 prepares the reset, mode and command words for a receive operation, and step 294 enables receiver interrupts. The program then returns to the priority executive.

When the receive buffer of interface 46 receives a character, and is ready for transmitting the character to CPU 38, it generates a true $R_xR$ signal for interrupt controller 44, which, since step 294 has enabled receiver interrupts, generates an interrupt for CPU 38. When interrupted, CPU 38 stores what it is doing so it can properly return to the program being run, and the receiver interrupt program is entered at 298. Step 300 reads a data word and stores it in the buffer which holds the associated poll request. If more than one character or word can be received, step 302 checks to see if all data has been received. If more is to be received, step 304 increments the $R_x$ pointer and the routine returns to the interrupted program at 306. If all data has been received, step 302 advances to step 308 which resets bit position 2 of the buffer status word to signify reception completed, it resets the $R_x$ pointer, and it disables receiver interrupts. The interrupt routine then returns to the interrupted program at 304.

FIG. 14 is a flow chart of a memory access module or routine for CP 34, which is called by steps 212 and 246 of the CP program shown in FIG. 8. As hereinbefore stated, the present invention permits accessing of the shared memory 36 by CP 34, each time a memory cycle performed by DP 32 ends, because CP 34 has a higher priority than DP 32. In like manner, the higher priority processor may have short breaks in its memory operation where it can give a lower priority processor the chance to grab the bus for a memory cycle or two. However, CP 34 would not want to break into the middle of a DP memory operation, and vice versa, if there could be a conflict in the memory operation to be performed and the memory operation already being performed. For example, if DP 32 is writing CMI, CP 34 would not want to read CMI, as it could be obtaining a combination of old and new information. Also, if DP 32 is reading CSI, CP 34 would not want to start to write CSI, as DP 34 could then obtain a combination of old and new information. Rather than completely lock out one processor until the other has completed a complete memory operation, the present invention permits the memory cycles of two memory operations to be interleaved, when no potential conflict is detected. Thus, a substantial savings in processing time is obtained.

Figure 15:
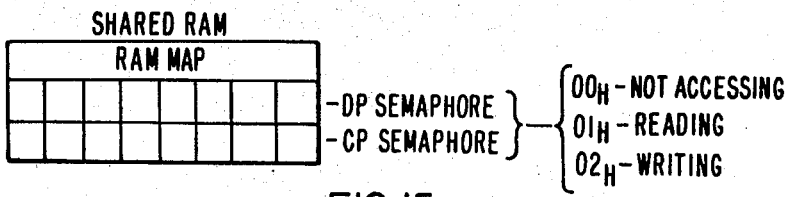
FIG. 15 is an exemplary format for the DP and CP semaphores which may be stored in RAM and used by the memory access programs of the DP and CP.

Potential conflicts are determined by assigning a semaphore to each processor. A semaphore is a byte in memory 36 which is set to a value by its associated processor, when it is accessing the shared memory 36, which value indicates the nature of the memory access. FIG. 15 sets forth an exemplary format for the DP and CP semaphores, with a value of 0000 0000 ($00_H$) indicating "not accessing", a value of $01_H$ indicating a memory read operation, and a value of $02_H$ indicating a memory write operation.

The memory access module is entered at a starting address in ROM 42 indicated at 310, and step 312 reads the DP semaphore. Step 314 determines if DP 32 is currently accessing the shared memory 36. If not, the semaphore value will be $00_H$, and if so, if will be nonzero. If DP 32 is accessing, step 316 compares the memory operation being performed, with the memory operation to be performed. Step 318 checks the result of this comparison. If the memory operation being performed by DP 32 is the same as the memory operation CP 34 desires to perform, there is no conflict, and the program proceeds to step 320. Thus, CP 34 is allowed to use its higher priority status to grab control of the system bus 78, when desired, at the finish of a DP 32 memory cycle. Step 314 also proceeds to step 320 when it finds DP 32 not accessing. If step 318 finds the memory operations to be different, i.e., one a memory read and one a memory write, step 318 returns to step 312 and the program cycles until step 314 or step 318 can proceed to step 320.

Step 320 locks the system bus, i.e., causes bus controller 122 to output a true $\overline{BUSY}$ signal, step 322 again checks the DP semaphore to make sure it has not gained access to the system bus since the last check, with steps 324, 326 and 328 duplicating steps 314, 316 and 318, respectively. If step 328 now finds a potential conflict, step 330 unlocks the system bus and the program returns to step 312. If step 344 finds the other processor not accessing, or step 328 finds no potential conflict, they both proceed to step 332 which checks the nature of the intended memory operation by CP 34. If step 334 finds the intended memory operation to be a write operation, step 334 sets the value of the CP semaphore shown in FIG. 15 to $02_H$. If step 332 finds the intended memory operation to be a read operation, step 336 sets the value to $01_H$. Steps 334 and 336 both proceed to step 338 which unlocks the system bus and the module returns to the CP program shown in FIG. 8. In steps 216 and 250, the "reset" of the semaphore is accomplished by locking the system bus 78, setting the associated semaphore to $00_H$, and unlocking the bus.

Figure 16:
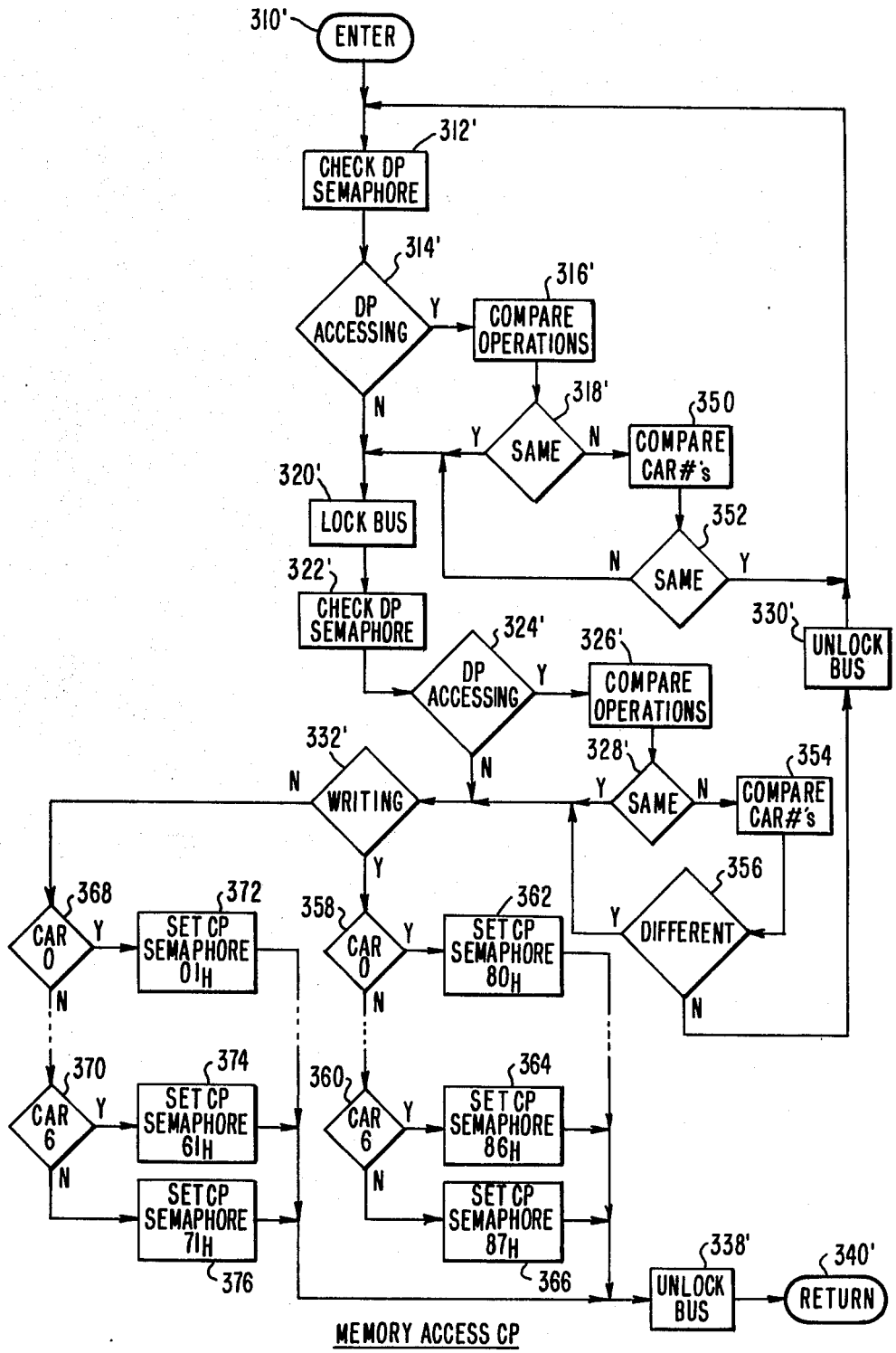
FIG. 16 is a flow chart of a second embodiment of a memory access module which may be called by the CP when it wishes to access shared memory.

FIG. 16 is a flow chart of a memory access module which may be used instead of the one shown in FIG. 14. Steps in the module of FIG. 16 which are similar to those of the module shown in FIG. 14 are given like reference numerals with the addition of a prime mark, and these steps will not be described in detail.

More specifically, the module of FIG. 16 will result in still less wait time than the module of FIG. 14, by adding a step 350 following step 318'. Instead of going into a waiting loop when step 318' finds that both read and write operations are involved, step 350 compares the car numbers involved in the read-write operations. Step 352 tests the comparison. If the car numbers are the same, an actual conflict would be created by the memory access, and the program would then go into a wait loop. If the car numbers are different, which will be the situation a large percentage of the time, no conflict exists, and step 352 proceeds to step 320'.

In like manner, step 354 compares car numbers and step 356 checks the result, when the DP semaphore is checked for the second time.

The remaining changes in the module of FIG. 16, compared with the module of FIG. 14, relate to the values to which the semaphore is set after performing step 332'. There will now be a different read value for each car, and a different write value for each car. For example, if step 332' finds the intended memory operation is a write operation, step 358 and a plurality of similar steps, indicated by the circles, and ending in step 362, determines the car number involved in the write operation. If it is car 0, step 358 proceeds to step 362 which sets the CP value to $80_H$, for example. If step 360 determines it is car 6, step 364 sets the CP semaphore to $86_H$, for example. If step 360 finds it to be car 7, step 366 sets the CP semaphore to $87_H$, for example. In like manner, if step 332' finds the memory operation to be a read operation, steps 368–370 determine the car number and steps 372, 374 and 376 set the CP semaphore to a predetermined value. For example, step 372 may set the semaphore to $01_H$ to indicate a read operation for car 0, and to $71_H$ to indicate a read operation for car 7.

Figure 17:
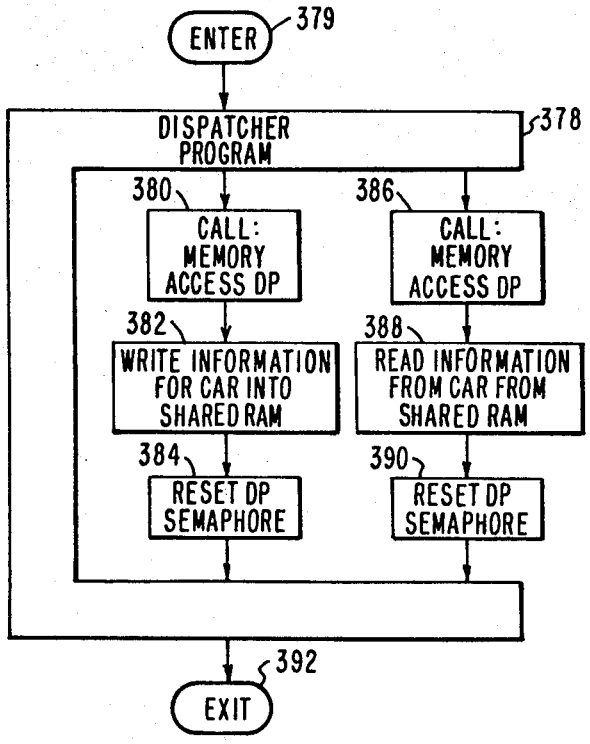
FIG. 17 is a flow chart of the dispatcher program, illustrating its memory accessing steps.

FIG. 17 is a flow chart which indicates that DP 32 would call a memory access module similar to that of FIG. 14 or 16, when it wishes to perform a read or write memory operation relative to shared memory 36. The main DP program may be that shown in incorporated U.S. Pat. No. 3,851,733 or in U.S. Pat. No. 4,037,688, which is also assigned to the assignee of the present application, or any other suitable program.

More specifically, DP 32 enters its program 378 at a starting address 379 in its ROM. When DP 32 prepares CMI for an elevator car and wishes to store it in shared memory 36, it calls a memory module in step 380, which is similar to that shown in FIG. 14 or FIG. 16, and therefore need not be described in detail. Step 382 writes the information into memory 36, and step 384 resets the DP semaphore shown in FIG. 15. In like manner, step 386 calls the memory access module when it wants to read CSI in shared memory 36, step 388 reads the information when access is gained by step 386, and step 390 resets the DP semaphore after completion of the memory access process.

Figure 18:
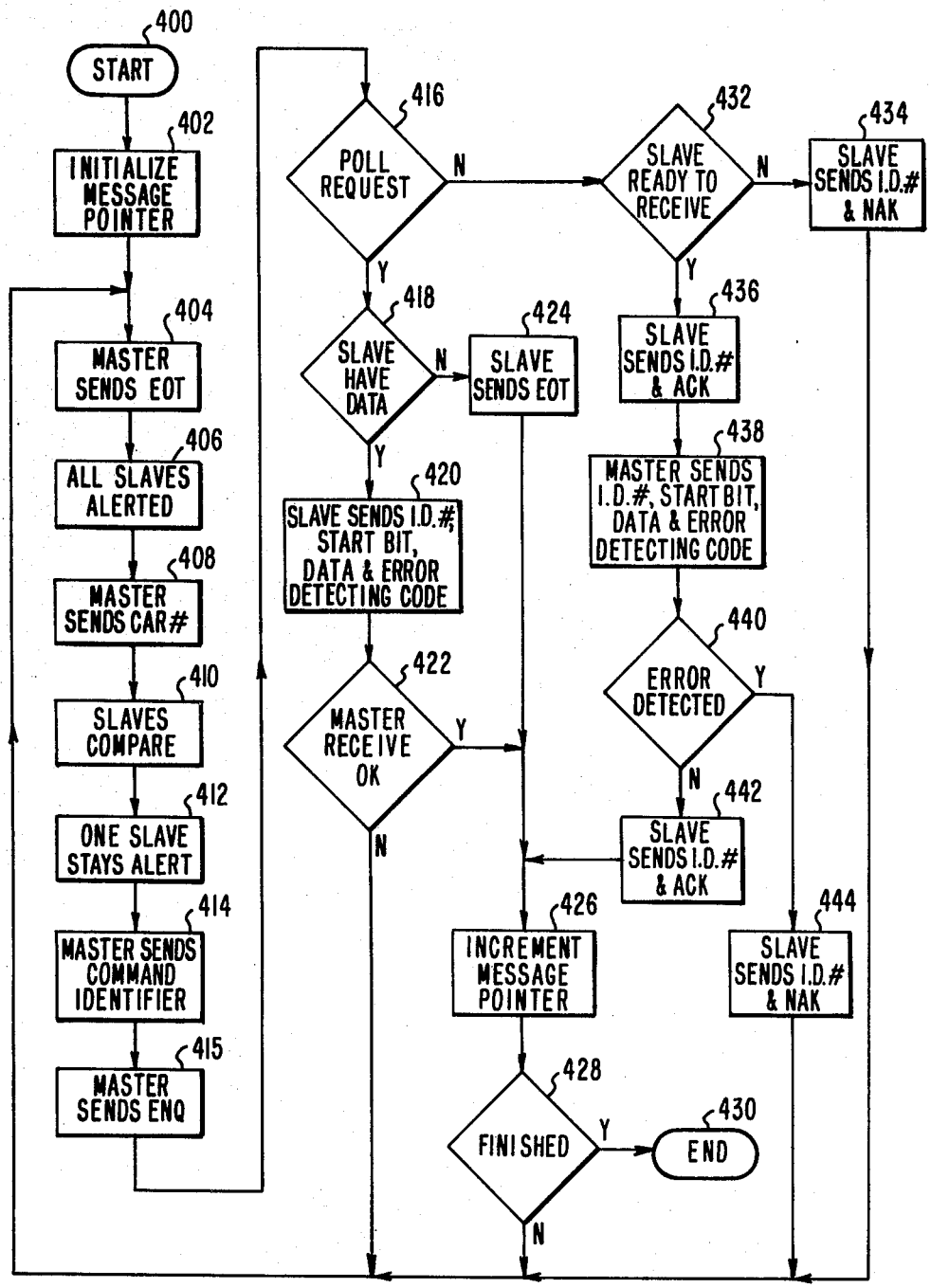
FIG. 18 is a functional block diagram which illustrates the steps of a master-slave sequence which may be used to communicate with the elevator cars over the serial data link and multi-drop configuration.
Figure 19:
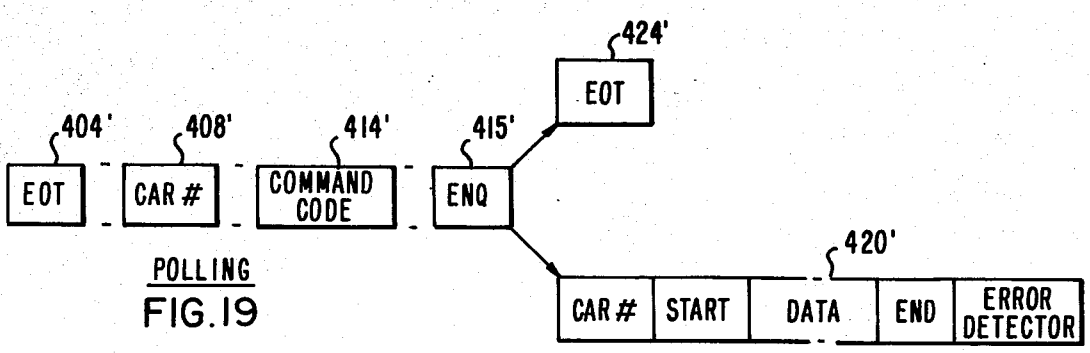
FIG. 19 sets forth an exemplary format for a poll request.
Figure 20:
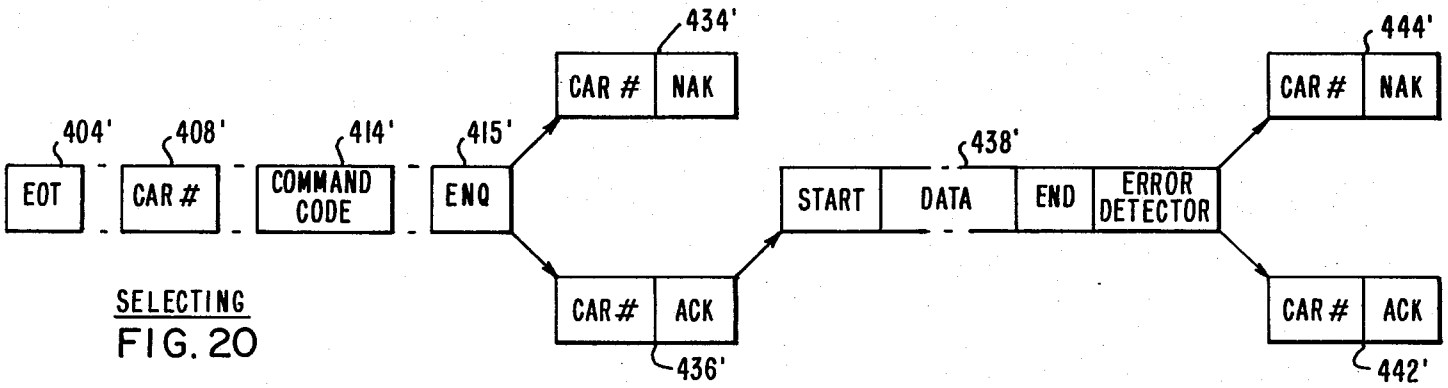
FIG. 20 sets forth an exemplary format for a select request.

FIGS. 18, 19 and 20 illustrate a serial communications protocol which may be used to communicate information between interface 46 and the elevator cars 37. It is based on the American National Standard Procedures protocol, subcategory 2.7, for two-way alternate, non-switched multipoint communication with centralized operation and multiple slave transmission, with interface 46 being the master and the per-car interfaces being the slaves, as indicated in FIG. 4. FIG. 18 is not a program flow chart, but is set up as such in order to more easily describe the serial chain of events. FIGS. 19 and 20 illustrate message formats for poll and select requests, respectively. The messages in the message formats of FIGS. 19 and 20 use the same reference numerals as the associated steps in FIG. 18, with the addition of a prime mark. Data is transmitted serially, with each word including a start bit, the data bits, a parity bit, and a stop bit. Certain control characters are used, which will be identified during the following description.

More specifically, the master-slave functional communications sequence starts at 400 and step 402 initializes a message pointer in ROM which points to the first character in the message to be sent. Interface 46 (master) sends a control character EOT, which character alerts all cars (slaves), as indicated at 406. Interface 46 then sends the car identification number, indicated at 408. The slaves compare this number with their own number, indicated at 410, and the identified slave stays alert, indicated at 414. Interface 46 then sends the command identifier command code, indicated at 414, which distinguishes poll and select requests, and it follows this with the control character ENQ, which the slave recognizes as a request for a response.

The selected slave examines the command code, indicated at 416, to determine if the request is a poll or a select request. If a poll request, the slave determines if it has data (CSI) to send, indicated at 418. If so, the polled elevator car sends it car identification number, a start bit, the data bits, an end bit and an error detecting code, as indicated at 420. The master, at 422, checks to see if it has correctly received the transmission. If not, step 422 returns to step 404, to start the process over, transmitting the same message to the same elevator car. If error check 422 finds no error, the message pointer is incremented at 426 and a check is made at 428 to determine if the message has been completely sent. If not, the process returns to 404 to send the next character. If the information has all been sent, the communication process ends at 430.

If the request is a select request, instead of a poll request, step 416 would proceed to 432 to determine if the slave is ready to receive CMI. If it is not ready for some reason, it sends its car identification number and a control character NAK. The master may repeat the process of trying to send the same message to the same car until it is ready to receive, as indicated in FIG. 18, with a software timer escape from the loop, or it may proceed to step 426, as desired.

If step 432 finds the slave ready to receive, the slave sends its car identification number and an acknowledgement character ACK, as indicated at 436. Upon receiving ACK, the master, at 438, sends a start bit, the data bits, an end bit, and an error detecting code. The slave checks to see if it has detected an error. If no error is detected, the slave sends its car identification number and control character ACK, to indicate a good transmission and reception. This is indicated at 422, and the message pointer is incremented at 426. If an error is detected, the slave sends its identification number and the control character NAK, indicated at 444, and the process starts over at 404, in an attempt to send the same message correctly.

Figure 21:
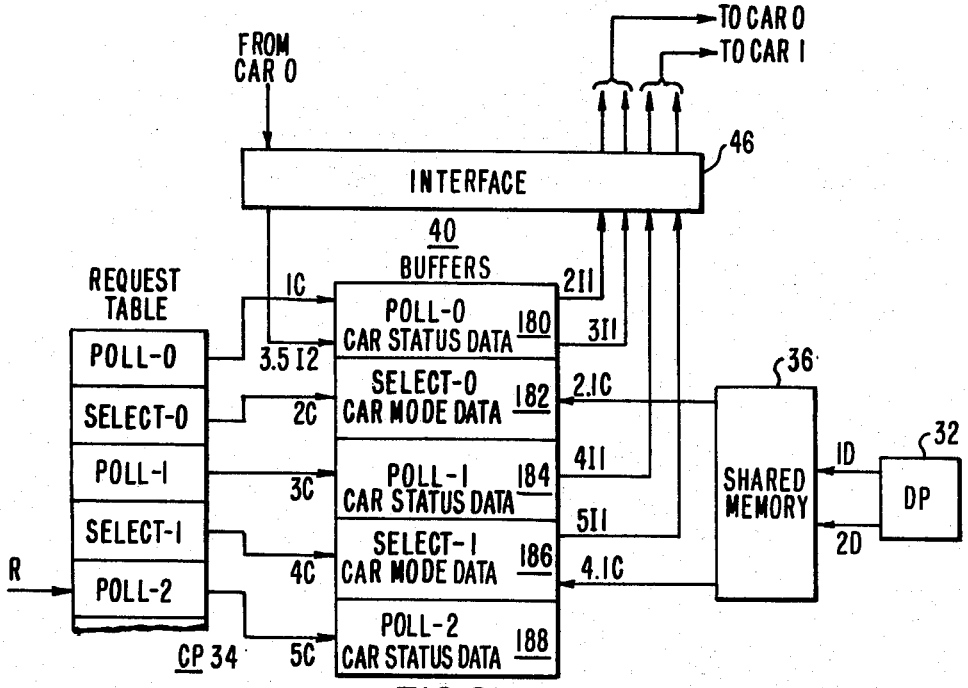
FIG. 21 is a functional block diagram which illustrates the first pass or "load" pass through the buffers by the CP, as it performs the program shown in FIG. 8.
Figure 22:
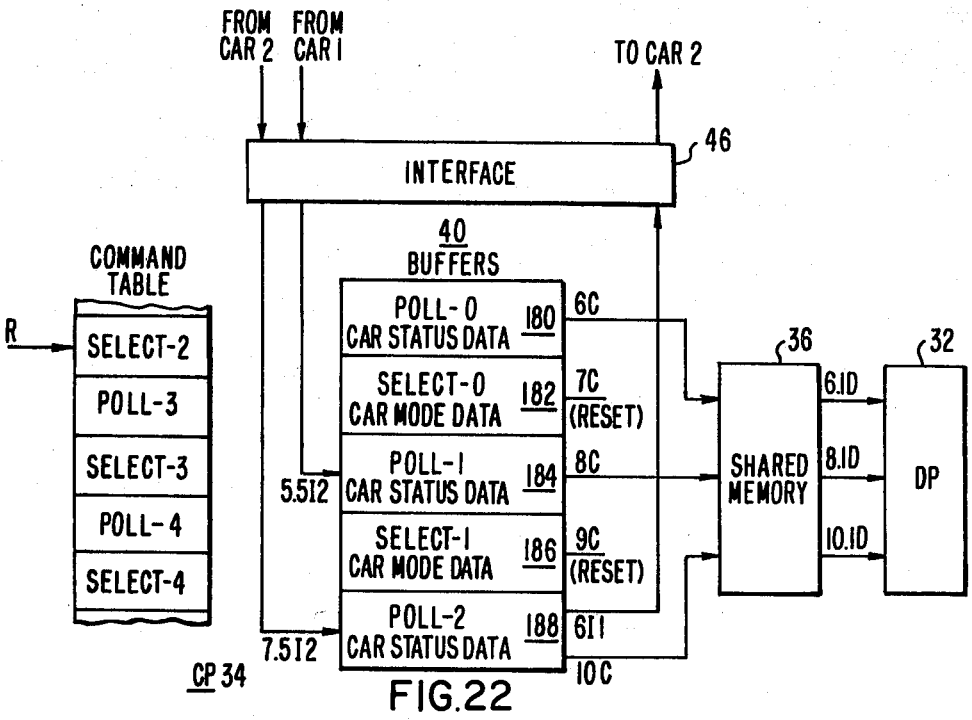
FIG. 22 is a functional block diagram, similar to that of FIG. 18, except illustrating the second or "unload" pass through the buffers by the CP, as it performs the program shown in FIG. 8.

FIGS. 21 and 22 summarize the operations of the programs hereinbefore described, insofar as they refer to the flow of CMI and CSI between the elevator cars and the dispatcher. FIG. 21 illustrates a pass through the buffers, as described in detail relative to FIG. 8, in which they are loaded with poll and select requests, as well as CMI. FIG. 22 illustrates the next pass through the buffers, also set forth in FIG. 8. The numeric references on the information flow lines refer to time, in order to assign relative occurrence times to the events. The letter C refers to operations initiated by CP 34, the letter I refers to operations initiated by interface 46, and the letter D refers to operations initiated by DP 32. I1 indicates interface operations responsive to $T_xR$ and I2 indicates interface operations responsive to $R_xR$. As illustrated, the first five requests from the Request Table are successively loaded in buffers 180, 182, 184, 186 and 188 at times 1C, 2C, 3C, 4C and 5C, respectively. DP 32 writes CMI into shared memory 36 at times 1D and 2D. The interface 46 with its transmitter ready and receiver ready signals $T_xR$ and $R_xR$, respectively, start the process of transmitting CMI and poll requests to the elevator cars at times 2I1, 3I1, 4I1, and 5I1 from buffers 180, 182, 184 and 186, respectively. The poll requests elicit responses from the addressed elevator cars, and CSI arrives from car 0 at time 3.5 I2. Thus, by the time the next pass is made through the buffers, CSI is already stored in buffer 180 when it is checked by the program, and CSI is transferred to shared memory 36 at time 6C. At time 6.1D, DP 32 reads the CSI. CSI continues to arrive from polled cars 1 and 2 at times 5.5I2 and 7.5I2. Buffer 182 is reset at 7C, buffer 184, loaded with CSI at 5.52 is written into memory 36 at time 8C, buffer 186 is reset at time 9C, and the CSI stored in buffer 188 at time 7.5I2 is transferred to memory at time 10C. DP 32 reads the CSI in shared memory 36 at times 8.1D and 10.1D. The times are exemplary and relative, to illustrate how the teachings of the invention interleave operations to reduce wait times in the transfer of information, which is of the utmost importance in an elevator system because the elevator system is a dynamic one, with changes occurring at a rapid rate. The faster information is transferred, the higher the probability that it will be timely, and therefore, represent the actual situation of the elevator system. The unique information transfer arrangement of CSI and CMI, using a shared memory, as well as the memory accessing arrangement of the shared memory, reduce the burdens placed upon the different processors, enabling them to perform their functions more efficiently and without wasteful waiting times which can reduce the effectiveness of the elevator system, regardless of how powerful the operating strategy is.

We claim as our invention:

1. A method of improving the two-way flow of information between the dispatcher processor and a plurality of elevator cars, comprising the steps of:

providing a communication processor, initiating all communication with the elevator cars by the communication processor, providing a memory which is shared by the dispatcher processor and the communication processor, preparing car mode information (CMI) for the elevator cars by the dispatcher processor, writing CMI into shared memory, reading shared memory by the communication processor to obtain CMI, sending CMI to the elevvator cars, preparing car status information (CSI) by the elevator cars, sending CSI to the communication processor, writing CSI by the communication processor into the shared memory, and reading the shared memory by the dispatcher processor to obtain CSI.

2. The method of claim 1 including the steps of providing a plurality of buffers for the communication processor and storing CMI in a buffer after the CMI memory reading step, with the step of sending CMI to the elevator cars including the step of reading it from a buffer, and wherein the step of sending CSI to the communication processor includes the step of storing it in a buffer, with the step of writing CSI into shared memory including the step of reading it from a buffer.

3. The method of claim 1 including the steps of providing an interface between the communication processor and the plurality of elevator cars, with the step of sending CMI to the elevator cars including the step of first sending it to the interface, and with the step of sending CSI to the communication processor including the step of first sending it to the interface.

4. The method of claim 1 including the steps of providing an interface between the communication processor and the elevator cars, providing a plurality of buffers for the communication processor, and storing CMI in a buffer after the CMI shared memory reading step, with the step of sending CMI to the elevator cars including the steps of reading it from a buffer and sending it to the interface, and wherein the step of sending CSI to the communication processor includes the steps of first sending it to the interface and then storing it in a buffer, and with the step of writing CSI into shared memory including the step of reading it from a buffer.

5. The method of claim 4 including the steps of providing a semaphore for the dispatcher processor, providing a semaphore for the communication processor, setting the communication processor semaphore to values which indicate when the communication processor is writing into the shared memory, and when the communication processor is reading the shared memory, setting the dispatcher processor semaphore to values which indicate when the dispatcher processor is writing into shared memory, and when the dispatcher processor is reading the shared memory, checking the semaphore of the other processor before writing into or reading the shared memory, determining if a potential conflict exists between the intended memory operation and the memory operation indicated by the value of the semaphore of the other, and proceeding with the intended memory operation when no potential conflict exists.

6. The method of claim 5 wherein the steps of setting the dispatcher processor and communication processor semaphores includes the step of indicating the associated elevator car in the value of the semaphore.

7. A method of operating an elevator system having a plurality of elevator cars, a dispatcher processor, and a communication processor which controls information flow between the elevator cars and the dispatcher processor, comprising the steps of:

providing memory means to be shared by both the dispatcher processor and the communication processor, accessing the memory means by the dispatcher processor to write car mode information for the elevator cars, accessing the memory means by the communication processor to write car status information for the dispatcher processor, accessing the memory means by the dispatcher processor to read car status information, accessing the memory means by the communication processor to read car mode information, providing a semaphore for each of the dispatcher processor and communication processor, which semaphores are settable by the associated processor to indicate the nature of the memory access, each of said accessing steps including the steps of:

(a) checking the semaphore of the other before setting its own semaphore, and (b) setting its semaphore and accessing the memory, not withstanding the semaphore of the other being set, when the checking step detects no potential conflict in memory operations.

8. The method of claim 7 wherein the step of setting a semaphore includes the step of setting it to indicate (a) a memory read, and (b) a memory write operation, as appropriate, with potentially conflicting memory operations being read and write operations.

9. The method of claim 7 wherein the step of setting a semaphore includes the step of setting it to indicate memory read and memory write operations, as appropriate, for an identified elevator car, with potentially conflicting memory operations being read and write operations for the same elevator car.

10. The method of claim 7 including the steps of providing a common bus between the shared memory, the dispatcher processor, and the communication processor, and, following the checking step, the additional steps of locking the bus when no potential conflict in memory operations is detected by the checking step, checking the semaphore of the other for the second time, unlocking the bus without setting its semaphore if a potential conflict in memory operations is detected by the second checking step, and otherwise performing the setting step, followed by the additional step of unlocking the bus.

11. The method of claim 7 including the steps of:

providing interface means between the communication processor and the elevator cars, providing buffer means, transferring car mode information read by the communication processor to said buffer means, providing a first signal for the communication processor when the interface means is ready to transmit information to the elevator cars, and transmitting the car mode information from the buffer means to a selected elevator car via said interface means in response to said first signal.

12. The method of claim 7 including the step of polling an identified elevator car by the communication processor for car status information, transmitting car status information from the identified elevator car to the interface means, providing a second signal for the communication processor when the interface means receives the car status information, transferring the car status information from the interface means to the buffer means in response to said second signal, and wherein the step of accessing the memory means by the communication processor to write car status information includes the step of obtaining the car status information from the buffer means.

13. The method of claim 7 including the steps of:

providing interface means between the communication processor and the elevator car, providing a plurality of buffers, providing a request table which includes select requests, each of which alert an identified elevator car to receive car mode information, and poll requests, each of which request an identified elevator car to provide car status information, loading the buffers in a predetermined sequence with different requests from the request table, and wherein the accessing step by the communication processor which reads car mode information includes the steps of transferring appropriate car mode information from the shared memory means to a predetermined buffer each time a select request is loaded into a buffer, with the car mode information being stored in the same buffer as the associated select request, providing a first signal for the communication processor each time the interface means is ready to transmit information to the elevator cars, transmitting select requests and related car mode information, and poll requests, from the buffers to the elevator cars via the interface means in a predetermined sequence, in response to the first signals, transmitting car status information from each elevator car identified in a poll request to the interface means, providing a second signal each time the interface means receives car status information, transferring car status information from the interface means to a predetermined buffer in response to the second signals, and wherein the access step in which the communication processor writes car status information into the memory means includes the step of obtaining the car status information from a buffer.

14. The method of claim 13 wherein the step of transferring car status information from the interface means to the buffer means stores the car status information in the same buffer in which the associated poll request is stored.

15. The method of claim 13 wherein the step of providing a request table includes the step of arranging the poll and select requests alternately, with the step of loading the buffers with requests from the request table taking the requests in sequence.

16. The method of claim 13 wherein the steps of loading the buffers from the request table and shared memory means, and the step of obtaining the car status information written into the shared memory means by the communication processor, starts with the buffer loading step and cycles continuously, loading all of the buffers in a predetermined sequence, and obtaining car status information from the buffers for the memory means in the same continuous cycle and same sequence, and wherein the steps of transmitting car mode information from the buffers to the elevator cars via the interface means, and the step of transferring car status information to the buffers from the interface means in response to the first and second signals, respectively, occur between certain of said cycling steps, with the first signal responsive unloading steps starting after the initiation of the cyclic loading, and with the second signal responsive loading steps terminating before the termnation of the cyclic step of obtaining information from the buffers.

17. The method of claim 7 including the steps of:

providing buffer means having a plurality of buffers, providing interface means between the buffer means and the elevator cars, providing first and second signals for the communication processor when the interface means is ready to transmit information to an elevator car and when it has received information from an elevator car, respectively, providing polling requests, polling the elevator cars by the communication processor for status information, with said polling step including the step of loading the buffer means with a polling request for an identified elevator car, providing select requests, selecting an elevator car by the communication processor to receive car mode information, with the selecting step including the step of loading the buffer means with a select request for an identified elevator car, and wherein the step of accessing the shared memory means to read car mode information includes the step of transferring the car mode information obtained in the read operation to the same buffer of the buffer means in which the associated select request is stored, transmitting car mode information from the buffer means to an elevator car via the interface means, in response to a first signal, transmitting car status information from an elevator car to the interface means in response to a polling step, and transferring car status information from the interface means to the buffer means in response to a second signal.

18. A method of operating an elevator system having a plurality of elevator cars, a dispatcher processor, and a communication processor which controls information flow between the elevator cars and the dispatcher processor, comprising the steps of:

providing memory means to be shared by both the dispatcher processor and the communication processor, providing interface means between the communication processor and the elevator cars, providing buffer means for the communication processor, accessing the memory means by the dispatcher processor to write car mode information for the elevator cars, accessing the memory means by the communication processor to read the car mode information, transferring the car mode information from the memory means to said buffer means, providing a first signal for the communication processor when the interface means is ready to transmit information to the elevator cars, and transmitting the car mode information from the buffer means to a selected elevator car via said interface means in response to said first signal.

19. The method of claim 18 including the step of polling an identified elevator car by the communication processor for status information, transmitting car status information from the identified elevator car to the interface means, providing a second signal for the communication processor when the interface means receives the car status information, transferring the car status information from the interface means to the buffer means in response to said second signal, accessing the memory means by the communication processor to write the car status information stored in said buffer means in the shared memory means, and accessing the memory means by the dispatcher processor to read car status information.

20. The method of claim 18 wherein the step of providing buffer means provides a plurality of buffers, and including the steps of:

providing a request table which includes select requests, each of which alert an identified elevator car to receive car mode information, and poll requests, each of which requests an identified elevator car to provide car status information, loading the buffers sequentially with different requests from the request table, with the accessing and storing steps performed by the communication processor transferring appropriate car mode information from the shared memory means to a predetermined buffer each time a select request is loaded into a buffer, providing a first signal each time the interface means is ready to transmit information to the elevator cars, with the transmitting step unloading the requests in the buffers sequentially in response to the first signals by transmitting the information in the buffers to the elevator cars via the interface means, transmitting car status information from each elevator car identified in a poll request to the interface means, providing a second signal each time the interface means receives car status information, transferring car status information from the interface means to predetermined buffers in response to the second signals, accessing the memory means by the communication processor, with the accessing step including the steps of unloading the buffers in sequence, and writing the car status information from the buffers in the accessed memory means.

21. The method of claim 18 wherein the predetermined buffer in which the loading step loads car status information is the same buffer in which the associated poll request is stored.

22. The method of claim 18 wherein the step of providing a request table includes the step of arranging the poll and select requests alternately, and the step of loading the buffers with requests from the request table takes the requests in sequence.

23. The method of claim 18 wherein the predetermined buffer in which the transferring step loads car mode information is the same buffer in which the associated select request is stored.

24. The method of claim 18 wherein the steps of loading the buffers from the request table and shared memory means, and the steps of unloading the buffers and writing the car status information in the shared memory means, starts with the loading step and cycles continuously, loading all of the buffers in a predetermined sequence, and continues to cycle while unloading all of the buffers in the same sequence, and wherein the steps of unloading the buffers by transmitting car mode information to the elevator cars, and transferring car status information to the buffers, in response to the first and second signals, respectively, occur between certain of said cycling steps, with the unloading step which is responsive to the first signal starting after the initiation of the cyclic loading, and with the loading step responsive to the second signal terminating before the termination of the cyclic unloading.

25. The method of claim 18 including the steps of:

providing poll requests, polling the elevator cars for car status information, with said polling step including the step of loading the buffer means with a poll request for an identified elevator car, providing a second signal when the interface means has received car status information from an elevator car, and wherein the accessing and storing steps by the communication processor include the step of selecting an elevator car to receive car mode information, with the selecting step further including the step of loading the buffer means with a select request for an identified elevator car, with the storing step loading car mode information in the same buffer in which the associated select command is stored, transmitting car status information from an elevator car to the interface means in response to a poll request, and transferring car status information from the interface means to the buffer means in response to a second signal.

26. An elevator system, comprising:

a plurality of elevator cars, dispatcher processor means for controlling the movement of said elevator cars, communication processor means for polling the elevator cars for information for use by said dispatcher processor means, and for selecting an elevator car to receive information from said dispatcher processor means, memory means, a bus interconnecting said dispatcher processor means, said communication processor means, and said memory means, enabling said memory means to be shared by said dispatcher processor means and said communication processor means, said dispatcher processor means including means for preparing car mode information for said elevator cars, and means for writing said car mode information into said shared memory means, said communication processor means including means for reading said shared memory means to obtain car mode information, and means for transmitting said car mode information to associated elevator cars, said elevator cars including means for providing car status information, said communication processor means including means for obtaining car status information from the elevator cars, and means for writing said car status information into said shared memory means, said dispatcher means including means for reading said shared memory means to obtain said car status information, first semaphore means associated with said dispatcher means, said first semaphore means being settable to indicate the nature of the memory operation, when the bus is accessed by said dispatcher means, and second semaphore means associated with said communication processor means, said second semaphore means being settable to indicate the nature of the memory operation, when the bus is accessed by said communication processor means, said dispatcher means and said communication processor means each including means for checking the semaphore of the other processor before setting its own semaphore, and means for setting its own semaphore and for accessing the bus when no potential conflict in memory operations is detected.

27. The elevator system of claim 26 wherein the first and second semaphores are settable to indicate read and write memory operations, as appropriate, by the dispatcher means and communication control means, respectively, with potentially conflicting memory operations being read and write operations.

28. The elevator system of claim 26 wherein the first and second semaphores are settable to indicate read and write memory operations, as appropriate, and also to indicate the associated elevator car, with potentially conflicting memory operations being read and write memory operations for the same elevator car.

29. The elevator system of claim 26 wherein the communication processor means includes buffer means for storing car mode information obtained from the shared memory means, interface means disposed in the flow of information between the communication processor means and the elevator cars, said interface means providing a first signal when it is ready to transmit information to an elevator car, and including means for transmitting car mode information from the buffer means to a selected elevator car via said interface means in response to said first signal.

30. The elevator system of claim 26 wherein the communication processor includes means for polling a predetermined elevator car for car status information, and including means for transmitting car status information from the predetermined elevator car to the interface means, said interface means providing a second signal for the communication processor when the interface means receives the car status information, and means for transferring the car status information from the interface means to the buffer means in response to said second signal, with the communication processor including means for accessing the shared memory means to write the car status information stored in the buffer means into the memory means.

31. An elevator system, comprising:

a plurality of elevator cars, dispatcher processor means for controlling the movement of said elevator cars, communication processor means for polling the elevator cars for information for use by said dispatcher processor means, and for selecting an elevator car to receive information from said dispatcher processor means, memory means, a bus interconnecting said dispatcher processor means, said communication processor means and said memory means, enabling said memory means to be shared by said dispatcher processor means and said communication processor means, said dispatcher processor means including means for preparing car mode information for said elevator cars, and means for writing said car mode information into said shared memory means, said communication processor means including means for reading said shared memory means to obtain car mode information, and means for transmitting said car mode information to associated elevator cars, said elevator cars including means for providing car status information, said communication processor means including means for obtaining car status information from the elevator cars, and means for writing said car status information into said shared memory means, said dispatcher processor means including means for reading said shared memory means to obtain said car status information, interface means between the communication processor and the elevator cars, a plurality of buffers, a request table which includes select requests, each of which alert an indentified elevator car to receive car mode information, and poll requests, each of which request an identified elevator car to provide car status information, said communication processor including means for loading the buffers in a predetermined sequence with different requests from the request table, means transferring appropriate car mode information from the shared memory means to a predetermined buffer, each time a select request is loaded into a buffer, with the car mode information being stored in the same buffer in which the associated select request is stored, said interface means providing a first signal for the communication processor each time it is ready to transmit information to the elevator cars, said communication processor initiating the transmission of status requests and related car mode information, and poll requests, from the buffers to the elevator cars via the interface means in a predetermined sequence, in response to the first signals, means transmitting car status information from each elevator car identified in a poll request to the interface means, said interface means providing a second signal each time it receives car status information, said communication processor including means for transferring car status information from the interface means to a predetermined buffer in response to a second signal, with the means which obtains car status information from the elevator cars obtaining it from the buffers.

32. The method of claim 31 wherein the means which transfers car status information from the interface means to the buffer means stores the car status information in the same buffer in which the associated poll request is stored.

33. The method of claim 31 wherein the poll and select requests are alternately arranged in the request table, and the means which loads the buffers with requests from the request table takes the requests in sequence.

* * * * *